US008414111B2

(12) United States Patent
Nakakubo

(10) Patent No.: US 8,414,111 B2
(45) Date of Patent: Apr. 9, 2013

(54) DEFLECTING ELECTRODE, DROPLET EJECTION HEAD, AND DROPLET EJECTION APPARATUS

(75) Inventor: Toru Nakakubo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 97 days.

(21) Appl. No.: 13/154,687

(22) Filed: Jun. 7, 2011

(65) Prior Publication Data

US 2011/0316940 A1 Dec. 29, 2011

(30) Foreign Application Priority Data

Jun. 24, 2010 (JP) ..... 2010-144285
Nov. 1, 2010 (JP) ..... 2010-245540

(51) Int. Cl.
*B41J 2/09* (2006.01)

(52) U.S. Cl. ..... 347/77

(58) Field of Classification Search ..... 347/73–82
See application file for complete search history.

(56) References Cited

U.S. PATENT DOCUMENTS

| | | | | |
|---|---|---|---|---|
| 4,223,318 | A | 9/1980 | Bogardus et al. | |
| 5,583,551 | A * | 12/1996 | Allred et al. | 347/77 |
| 2002/0118258 | A1 * | 8/2002 | Bajeux | 347/77 |
| 2003/0184620 | A1 * | 10/2003 | Shrivastava et al. | 347/77 |
| 2005/0122381 | A1 * | 6/2005 | Golombat et al. | 347/77 |
| 2007/0081051 | A1 * | 4/2007 | Otte et al. | 347/77 |

FOREIGN PATENT DOCUMENTS

| | | | | |
|---|---|---|---|---|
| JP | 59-003154 A | | 1/1984 | |
| JP | 401146752 | * | 6/1989 | 347/78 |

* cited by examiner

*Primary Examiner* — Kristal Feggins
(74) *Attorney, Agent, or Firm* — Fitzpatrick, Cella, Harper & Scinto

(57) ABSTRACT

A droplet ejection apparatus is able to realize, with a simple electrode configuration, functions for both converging effects that cause charged particles to head towards a single axis as well as deflecting effects that change the orientation of the axis of convergence. This can improve droplet landing precision in a charge deflection continuous stream droplet ejection apparatus.

12 Claims, 33 Drawing Sheets

* CHARGING ELECTRODE NOT ILLUSTRATED.

DEFLECTING ELECTRODE, DROPLET EJECTION HEAD, AND DROPLET EJECTION APPARATUS

BACKGROUND OF THE INVENTION

1. Field of the Invention

The present invention relates to a deflecting electrode for controlling charged particles, a droplet ejection head provided with the deflecting electrode, and a droplet ejection apparatus provided with the droplet ejection head. The present invention relates to inkjet apparatus.

2. Description of the Related Art

Droplet ejection apparatus referred to as continuous apparatus apply continuous pressure to droplets with a pump, push droplets out from nozzles, and additionally apply vibration by vibrating means. In so doing, such droplet ejection apparatus create a state wherein liquid ejected from nozzles forms droplets evenly. Since droplets are continuously ejected from nozzles with this method, it is necessary to sort the droplets used to print according to print data from the droplets that are not used. With a method referred to as the charge deflection method, sorting is conducted by selectively charging droplets, deflecting the droplets with an electric field, and causing the droplets to fly in a trajectory different from that of the non-charged droplets. Sorted non-print droplets are captured by a gutter and collected. In order to realize these functions, a charging electrode, deflecting electrode, and gutter are provided along the droplet flight trajectory from nozzles.

In order to configure an apparatus such that a liquid stream ejected from a nozzle forms droplets, and also such that deflection sufficient for sorting is applied by a deflecting electrode, a certain degree of distance is required from the nozzle to the print medium. For this reason, slight deviations in the angle of droplets ejected from a nozzle greatly affect landing precision. An electrostatic lens is typically known as an electrode configuration that focuses charged particles. An electrostatic lens creates an electric field symmetric about the lens axis by being provided with a plurality of electrodes in the charged particle travel direction. Types of electrostatic lenses may include immersion lens, cylinder lenses, and electrostatic single-lenses, depending on the shape and number of electrodes. A point shared in common by these circularly symmetric electrostatic lenses is that although the focal length changes according to the polarity and charge magnitude of the charged particles, the charged particles converge on the lens axis. In other words, in a typical electrostatic lens, all charged particles converge on the same axis.

In Japanese Patent Publication No. S59-003154 (1984), an electrode group so as to form an electrostatic lens is provided between a charging electrode for charging droplets and a deflecting electrode for sorting, and print droplet trajectory correction is conducted. By arranging electrodes having apertures with the same dimensions and shape along the droplet trajectory, the electrodes manifest the convergence effects described earlier.

Meanwhile, since the electrostatic lens disclosed in Japanese Patent Publication No. S59-003154 (1984) causes charged particles to converge on the lens axis regardless of the charged particle speed or polarity, it is necessary to separately provide a deflecting electrode and an electrostatic lens for converging in the case of deflecting charged particles. Consequently, at least two electrodes are required for deflecting and at least two electrodes are required for converging, for a total of four required electrodes. For this reason, there is a problem of increased manufacturing costs. Also, in a droplet ejection apparatus, there is also the possibility that the distance from the nozzles to the print medium may become longer and the droplet landing precision may decrease.

SUMMARY OF THE INVENTION

It is one object of the present invention to provide a deflecting electrode, a droplet ejection nozzle, and a droplet ejection apparatus able to realize, with a simple electrode configuration, functions for both converging effects that cause charged particles to head towards a single axis line as well as deflecting effects that change the orientation of the axis line of convergence. Another object of the present invention is to improve droplet landing precision in a charge deflection continuous stream droplet ejection apparatus.

According to an embodiment of the present invention, functions for both converging effects that cause charged particles to head towards a single axis line as well as deflecting effects that change the orientation of the axis line of convergence can be realized with a simple electrode configuration.

Further features of the present invention will become apparent from the following description of exemplary embodiments (with reference to the attached drawings).

DESCRIPTION OF THE EMBODIMENTS

A first embodiment of the present invention will be described. In the present embodiment, a droplet ejection apparatus is discussed, but a converging-deflecting electrode in accordance with the present invention is applicable to general charged particle control apparatus, such as electron microscopes and charged particle beam apparatus. Also, the ejected material of a droplet ejection apparatus of the present invention is not limited to being printer inks that use pigments, but is applicable to general chargeable liquids.

Also, although the term convergence implies deflection by definition, in the present invention, the term "deflection" is used in distinction from convergence. In other words, in the present invention, charged particles "converging" refers to changing the directions of charged particles having different flight trajectories such that the particles head towards a single point. Meanwhile, charged particles being "deflected" refers to changing the directions of charged particles having different flight trajectories such that the particles head in a specific direction. Also, charged particles "converging and being deflected" means causing particles to converge on a single axis, while additionally changing the orientation of the axis of convergence. Since a deflection electrode in the present invention has converging effects, it is herein referred to as a converging-deflecting electrode.

Figure 1:
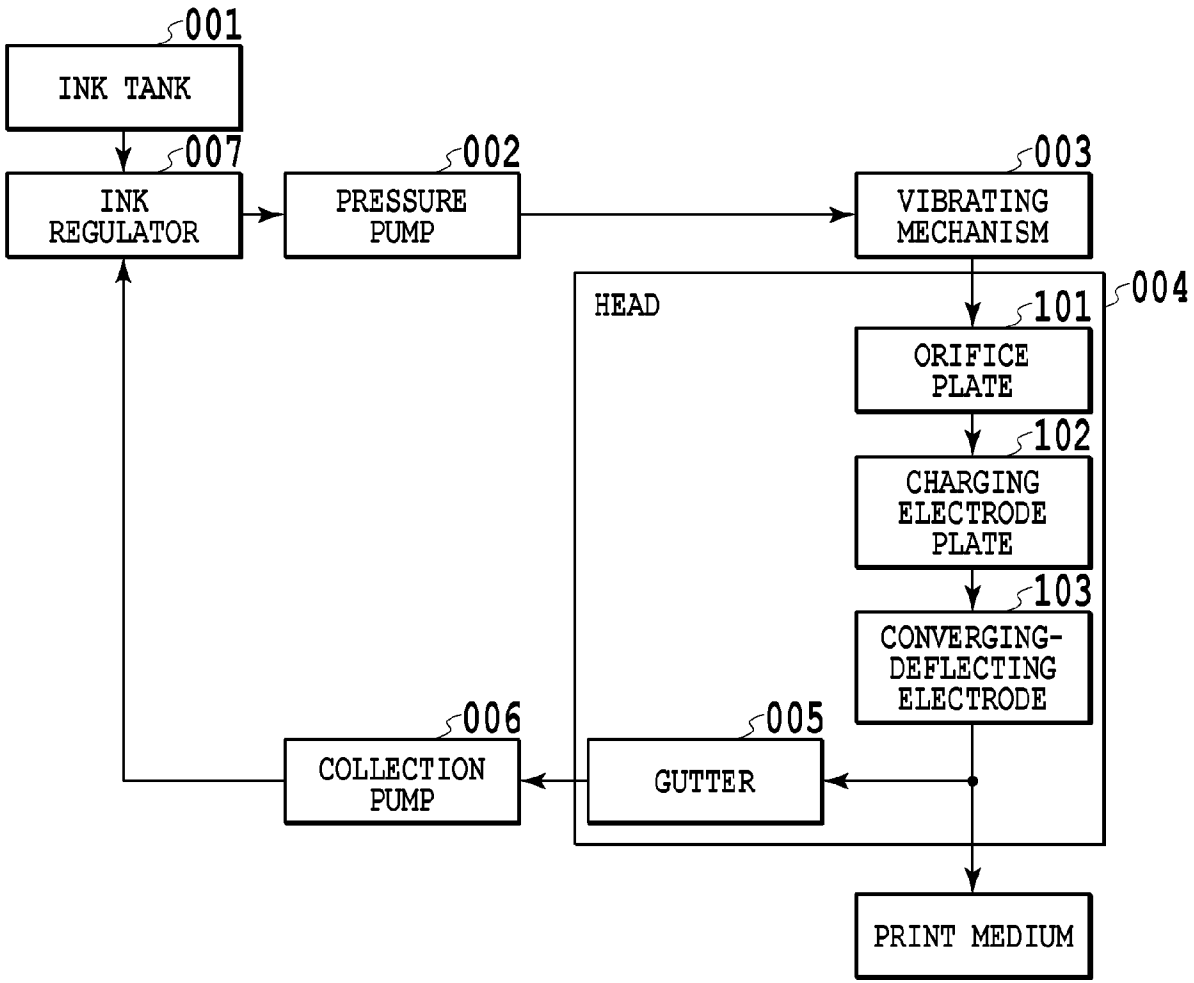
FIG. 1 is a schematic diagram of a droplet ejection apparatus of the present invention.

FIG. 1 is a schematic system diagram of a droplet ejection apparatus equipped with a droplet ejection head of the present invention. A droplet ejection apparatus of the present invention includes an ink tank 001, a pressure pump 002, a vibrating mechanism 003, a head 004, a collection pump 006, and an ink regulator 007.

Figure 2:
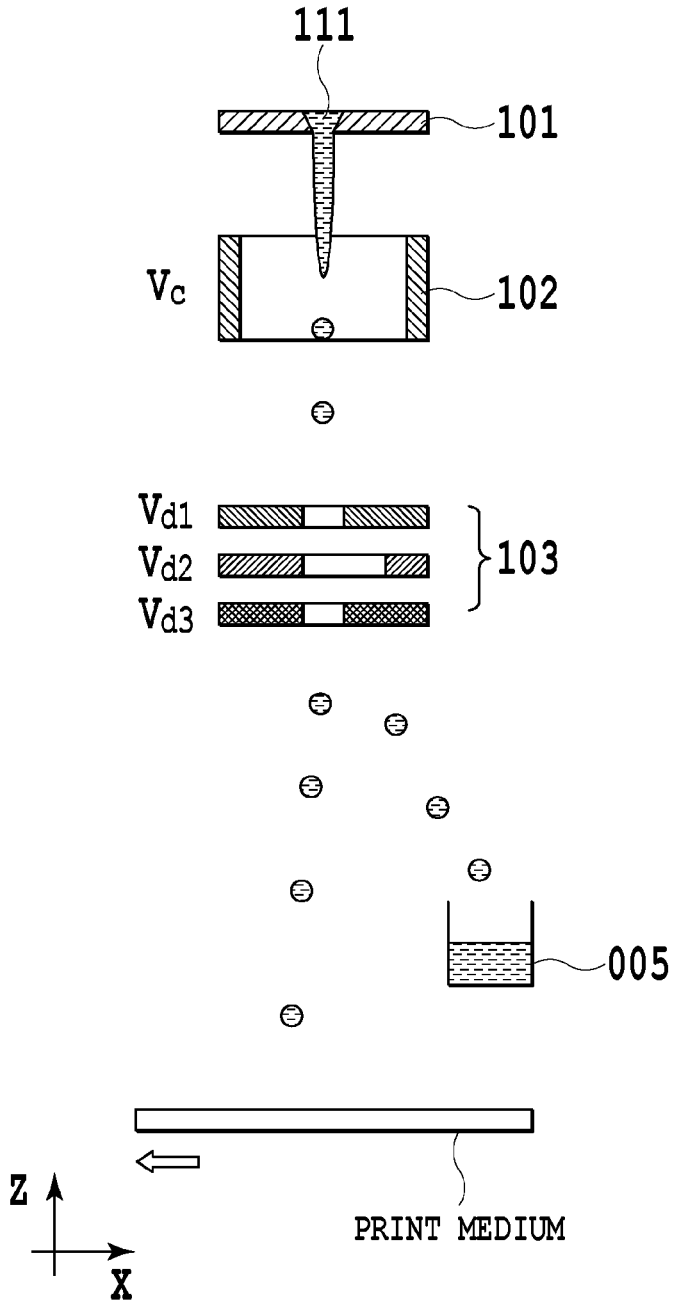
FIG. 2 is a schematic lateral view of a droplet ejection head of the present invention.

FIG. 2 is a schematic diagram of the configuration of a head unit of the present invention.

The head unit includes an orifice plate 101, a charging electrode plate 102, a converging-deflecting electrode 103, and a gutter 005, which are arranged in the order given above in the ink flight direction as illustrated in FIG. 2. Formed on the orifice plate 101 is a nozzle 111 from which droplets are ejected. On the charging electrode plate 102, there is provided an aperture through which ejected ink passes, with an electrode being formed around the aperture. The electrode is coupled to wiring and is configured such that a charging voltage can be individually applied thereto. The charging electrode plate 102 applies a first charge to droplets used for printing from among the flying droplets ejected from the nozzle. For droplets not used for printing, a second charge is applied which differs from the first charge in at least one from among charge magnitude and polarity, or alternatively, a charge is not applied.

The converging-deflecting electrode 103 is configured having a plurality of electrode plates arranged in the droplet flight direction, the electrode plates having apertures at portions where droplet flight trajectory axis lines pass through. Electrodes are respectively formed on each electrode plate of the converging-deflecting electrode 103. A conducting material such as metal may be used for the electrode plates themselves, with the electrodes being manufactured by forming apertures. Alternatively, an insulating material such as plastic, ceramic, or glass may be used as a support member for the electrode plates, and a conducting layer such as metal may be formed on the surface or lateral aperture walls, with the electrodes being manufactured by patterning. In the case of the former, the electrode shape and the aperture shape match, but in the case of the latter, electrodes can be shaped differently from the shapes of the apertures, allowing for more design freedom. Electrodes on a portion of the electrode plates are shaped symmetrically with respect to the droplet forward trajectory near the apertures through which droplets pass, while electrodes on the remaining electrode plates are shaped asymmetrically with respect to the droplet trajectory axis line near the apertures through which droplets pass.

The respective electrode plates of the converging-deflecting electrode 103 are insulated from each other and coupled to wiring such that a potential can be imparted by individually applying voltages thereto. By applying voltages to each electrode plate of the converging-deflecting electrode 103, an electric field is formed around the electrodes due to potential differences between electrodes. Due to the electrode shapes in the converging-deflecting electrode 103, a symmetric electric field is formed with respect to the droplet trajectory axis line near the apertures of electrode plates that include symmetric electrodes with respect to the droplet trajectory axis line near the apertures. Meanwhile, an asymmetric electric field is formed near the apertures of electrode plates that include asymmetric electrodes with respect to the droplet trajectory axis line near the apertures. By combining such symmetric electric fields and asymmetric electric fields, converging effects and deflecting effects are realized.

The gutter 005 includes an aperture part along the flight trajectory of non-print droplets, and is configured to capture non-print droplets.

Next, operation of a droplet ejection apparatus of the present invention will be described. First, a conductive ink is used in so that the ink can be charged. Ink stored in the ink tank 001 is compressed by the pressure pump 002 and supplied to the head 004. Ink supplied to the head 004 is imparted with vibration by the vibrating mechanism 003, passed through a common ink chamber 100, and ejected from the nozzle 111. When ink ejected from the nozzle 111 flies approximately 1 mm, the ink stream splits into a droplet. The charging electrode plate 102 is disposed such that the ink is passing through a through-hole at this position where the ink stream splits into a droplet. If a voltage is being applied to the electrodes when the ink stream splits into a droplet, the droplet is charged, whereas if a voltage is not being applied, the droplet is not charged. Also, the charge magnitude varies according to the size of the charging voltage. Consequently, the voltage applied to the charging electrodes is controlled so as to apply different charge magnitudes to the droplets used for printing and the droplets not used for printing in accordance with print data. In order to obtain converging effects, the charge magnitude must be non-zero. Consequently, the charge magnitude applied to print droplets in a droplet ejection apparatus of the present invention is non-zero in order to raise print precision. Meanwhile, although the charge magnitude applied to non-print droplets may be zero, the difference between this charge magnitude and the charge magnitude of print droplets is preferably as large as possible in order to effectively conduct sorting. Particularly, by differentiating the polarity between print droplets and non-print droplets, the deflection direction is reversed, and a large deflection can be obtained.

Subsequently, charged droplets are deflected from their droplet trajectory and converged to the same trajectory in the converging-deflecting electrode 103. Since the charge magnitude differs between print droplets and non-print droplets, the deflection magnitude differs, and the droplet trajectory is divided in two, with the print droplets landing on the print medium of the converging-deflecting electrode, and the non-print droplets being deflected, landing in the gutter 005, and collected. Collected ink is suctioned by the collection pump 006, and after being subjected to foreign material removal and viscosity regulation in the ink regulator 007, the ink is once again compressed by the pressure pump 002 and recirculated to the head for printing.

First Embodiment

Figure 3:
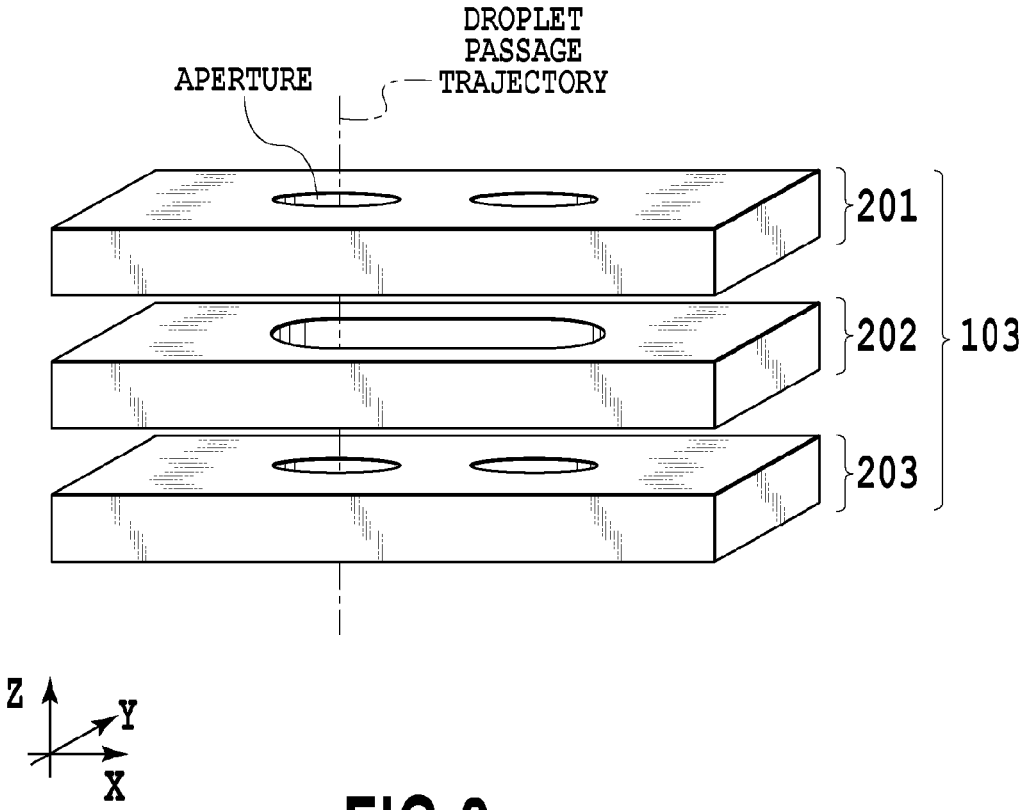
FIG. 3 is a perspective view of a converging-deflecting electrode in a first embodiment of the present invention.
Figure 4A:
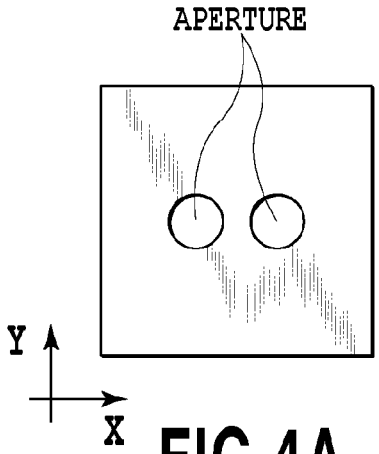
FIGS. 4A to 4D are top views of a converging-deflecting electrode plate in a first embodiment of the present invention, and diagrams illustrating the electric field of the converging-deflecting electrode.
Figure 4B:
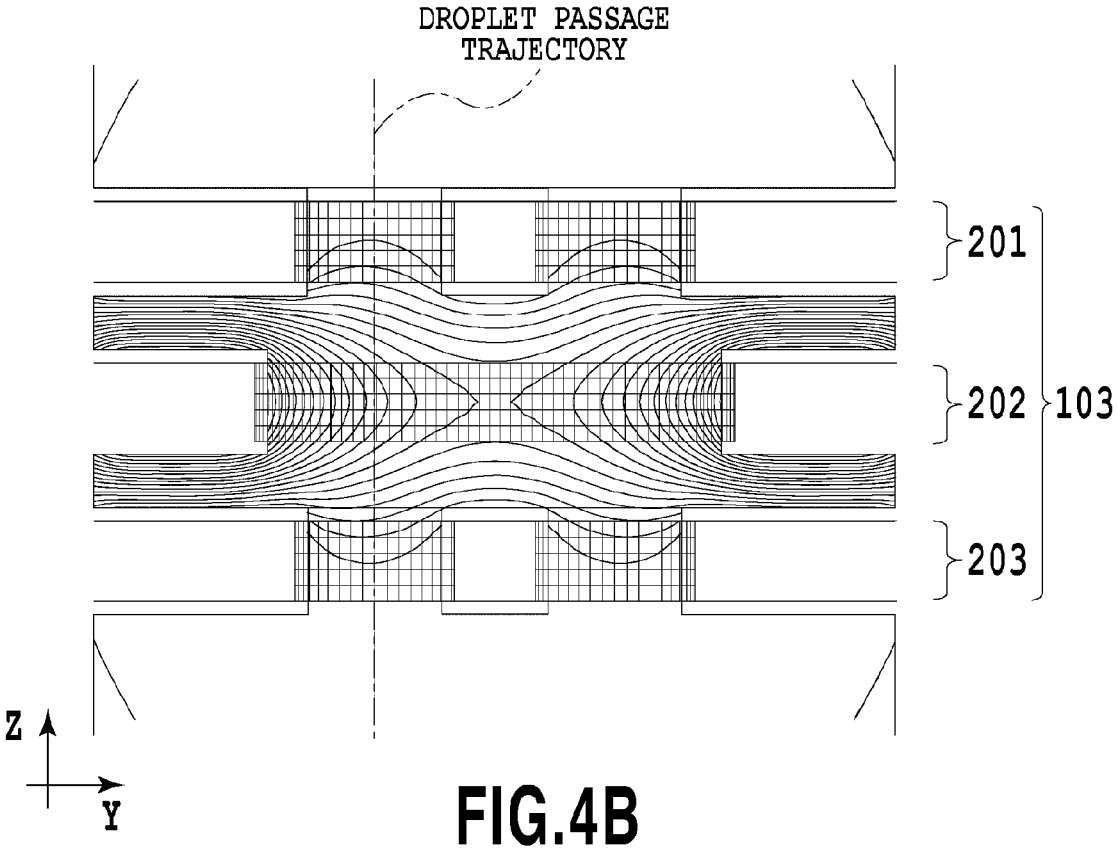

A first embodiment of the present invention will now be described. FIG. 3 illustrates a perspective view of a converging-deflecting electrode 103 in the present embodiment. The converging-deflecting electrode 103 includes three electrode plates: a first converging-deflecting electrode plate 201, a second converging-deflecting electrode plate 202, and a third converging-deflecting electrode plate 203. FIG. 4A illustrates a top view of the first converging-deflecting electrode plate 201 and the third converging-deflecting electrode plate 203, while FIG. 4B illustrates a top view of the second converging-deflecting electrode plate 202. As illustrated in the drawings, the Z axis is defined to be an axis perpendicular to the nozzle plane and becoming negative in the ejection direction. The X axis and Y axis are defined on a plane perpendicular to the Z axis. The X axis and the Y axis are orthogonal.

The converging-deflecting electrode plate 201, 202, and 203 all have apertures (gaps) through which droplets pass. In the present embodiment, a metal plate of thickness 50 μm is used for each electrode plate, with the aperture shape becoming the electrode shape. The respective electrodes are arranged at 50 μm intervals. In order to keep this interval, the electrodes may be peripherally supported, or insulating spacers of thickness 50 μm may be inserted between the electrode plates. Materials such as glass, plastic, ceramics, and rubber may be used for the insulating spacers. By providing insulating spacers, it is not only easy to keep the electrode interval constant, but in addition, resistance to dielectric breakdown between electrodes can be increased.

The aperture shape of the first converging-deflecting electrode plate 201 and the third converging-deflecting electrode plate 203 is such that two circular apertures of diameter 100 μm are provided and mutually separated from each other in the X-axis direction by 150 μm. Droplets pass through the center of one of the two apertures (the left aperture in FIG. 4A). As illustrated in FIG. 4B, the aperture of the second converging-deflecting electrode plate 202 takes an oval shape in which two semicircles having a 100 μm radius of curvature are joined with their centers separated from each other by 100 μm.

The shapes of the apertures of the first converging-deflecting electrode plate 201 and the third converging-deflecting electrode plate 203 through which droplets pass through are circularly symmetric with respect to the droplet forward trajectory. Meanwhile, the shape of the aperture of the second converging-deflecting electrode plate 202 through which droplets pass through is asymmetric with respect to the droplet forward trajectory.

The symmetry of the electrode apertures will now be discussed in further detail. Since the first converging-deflecting electrode plate 201 and the third converging-deflecting electrode plate 203 have another aperture other than the aperture through which droplets pass (the right aperture in FIG. 4A), the electrode overall is asymmetric with respect to the droplet forward trajectory. However, since the right aperture and the left aperture in FIG. 4A are completely separated due to the electrode shape, the left aperture contributes almost nothing to the formation of an electric field within the right aperture. In other words, the shape of the aperture through which droplets pass is crucial to the formation of an electric field around the aperture through which droplets pass. Thus, in the present invention, the shape of the aperture through which droplets pass refers to the edge shape (including the inner peripheral walls of the aperture on the electrode plate) of the conducting part formed so as to enclose the forward trajectory. In the case where the converging-deflecting electrode plates are formed of conductors, this matches the inner shape of the aperture through which droplets pass. In the case of FIG. 4A, the left aperture shape corresponds to the electrode shape around the aperture through which droplets pass, and thus it can be said that the aperture shape is symmetric with respect to the trajectory axis.

Other configuration details and operating conditions will now be described for a droplet ejection apparatus of the present embodiment. The nozzle diameter is 7.4 μm, and the pressure of the pressure pump 002 is 0.8 MPa. Also, the frequency of the vibrating mechanism 003 is approximately 50 kHz. In this case, the droplet size becomes 4 pL, and the ejection velocity becomes approximately 10 m/s. Flying droplets are slowed by air resistance, with the velocity becoming approximately 8 m/s when passing through the converging-deflecting electrode 103.

The charging electrode plate 102 is taken to have a thickness of 500 μm, with the aperture part being a circle of diameter 300 μm. The center in the thickness direction is positioned 1 mm away from the nozzle 111, with the plate positioned such that the droplet trajectory passes through the aperture center. A conducting layer is formed on the lateral aperture walls to form a cylindrical electrode. If the charging voltage applied to print droplets is taken to be 200 V and the charging voltage applied to non-print droplets is taken to be −200 V, the charge magnitude becomes $-3.0\times10^{-13}$ C and $3.0\times10^{-13}$ C, respectively. The converging-deflecting electrode 103 is positioned 2 mm away from the nozzle 111, the gutter 005 is positioned 2.5 mm away from the nozzle 111, and the print medium is positioned 3 mm away from the nozzle 111.

Figure 4C:
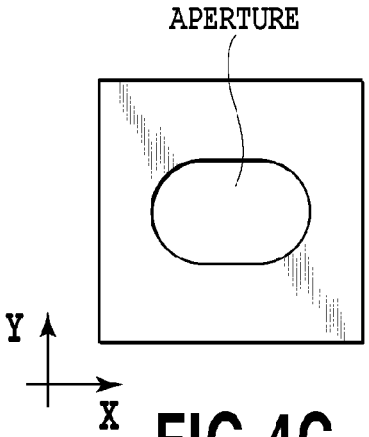

Equipotential lines of electric fields in the converging-deflecting electrode 103 and trajectories of charged droplets were simulated while taking the voltage $V_{d1}$ of the first converging-deflecting electrode plate 201 to be 0 V, the voltage $V_{d2}$ of the second converging-deflecting electrode plate 202 to be 300 V, and the voltage $V_{d3}$ of the third converging-deflecting electrode plate 203 to be 0 V. For the simulation, the 3D non-linear electrostatic field analysis software ELFIN (ELF Corporation) was used. FIG. 4C illustrates equipotential lines on the XZ plane. Electric fields symmetric with respect to the droplet forward trajectory are formed near the first converging-deflecting electrode plate 201 and the third converging-deflecting electrode plate 203. In contrast, an electric field symmetric with respect to the electrode plate aperture is formed near the second converging-deflecting electrode plate 202, and this electric field is asymmetric with respect to the droplet forward trajectory. As described in the embodiment, the question of whether the electric field shape is symmetric or asymmetric with respect to the trajectory axis depends on whether or not the electrode of an electrode plate (i.e., the aperture shape) is symmetric with respect to the droplet trajectory.

Figure 5:
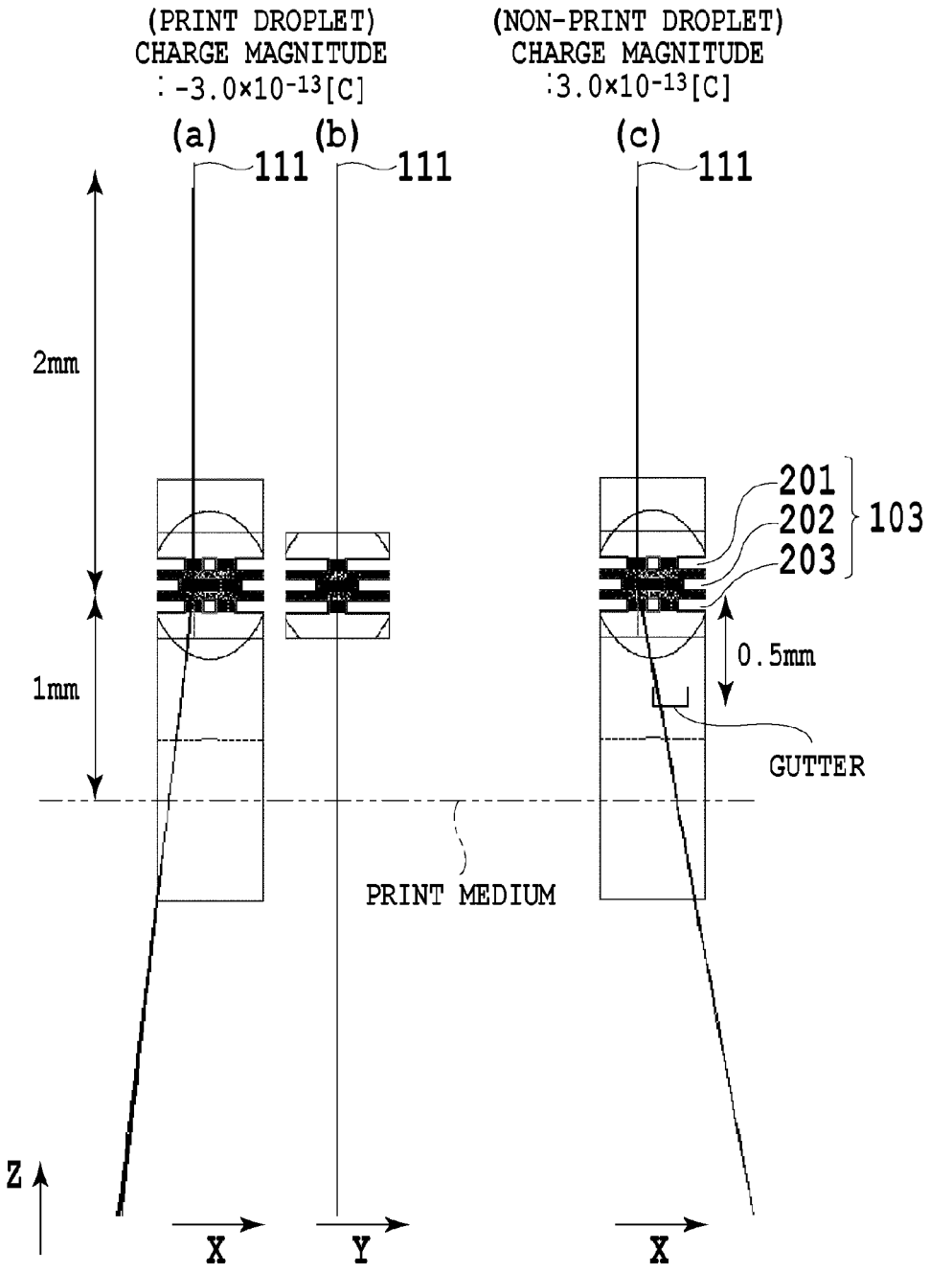
FIG. 5 illustrates droplet flight trajectories in a first embodiment of the present invention.
Figure 6A:
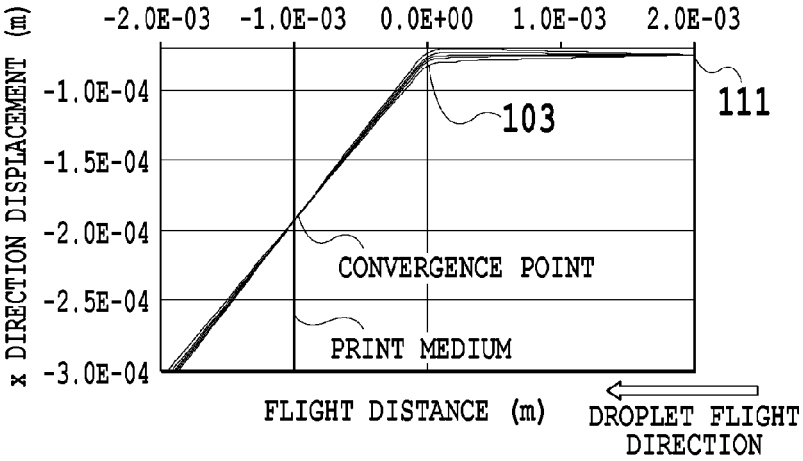
FIGS. 6A to 6C are graphs illustrating droplet flight trajectories in a first embodiment of the present invention.

(a) in FIG. 5 illustrates flight trajectories of negatively charged print droplets in the case where the angle of droplet ejection is shifted −2.5 mrad, −1 mrad, 0 mrad, 1 mrad, and 2.5 mrad in the X-axis direction with respect to the Z axis. As (a) in FIG. 5 demonstrates, when droplets pass through the converging-deflecting electrode 103, droplets are deflected in the −X direction while also converging on the deflected axis. FIG. 6A is a graph of more accurate droplet trajectories. FIG. 6A demonstrates that there is a convergence point at a point approximately 3 mm away from the nozzle 111. If the ejection direction is shifted 2.5 mrad, the landing position is shifted 7.5 μm in the case of no converging-deflecting electrode 103, whereas the shift becomes 0.45 μm due to the effects of the converging-deflecting electrode 103. Similarly, if the ejection direction is shifted 1 mrad, the landing position is shifted 3 μm in the case of no converging-deflecting electrode 103, whereas the shift becomes 0.15 μm due to the effects of the converging-deflecting electrode 103. Consequently, sufficient landing precision can be achieved even for a high-definition ejection head of 1200 dpi or more.

Since charged droplets in flight are subjected to forces perpendicular to the equipotential lines, the forces exerted on droplets passing through the converging-deflecting electrode 103 can be described as follows. Assume that a negatively charged droplet has entered the converging-deflecting electrode 103. Due to the electric field, the negatively charged droplet will accelerate while heading from the first converging-deflecting electrode plate 201 to the second converging-deflecting electrode plate 202, and decelerate while heading from the second converging-deflecting electrode plate 202 to the third converging-deflecting electrode plate 203. Also, if this droplet is shifted to the right (+X) with respect to the trajectory center as it travels, then the droplet will be subjected to a leftwards (−X) force when passing through near the first converging-deflecting electrode plate 201 and the third converging-deflecting electrode plate 203. In contrast, if the droplet is shifted to the left (−X) as it travels, the droplet will be subjected to a rightwards (+X) force when passing through near the first converging-deflecting electrode plate 201 and the third converging-deflecting electrode plate 203. In other words, converging effects are realized by the electric fields around the first converging-deflecting electrode plate 201 and the third converging-deflecting electrode plate 203. Meanwhile, the droplet will be subjected to a leftwards (−X) force while passing through near the second converging-deflecting electrode plate 202, regardless of its shift from the droplet trajectory. In other words, deflecting effects are realized by the electric field around the second converging-deflecting electrode plate 202. Also, the X-direction electric field at the second converging-deflecting electrode plate 202 is not uniform, and a droplet shifted farther leftwards (−X) will be subjected to a stronger force. Consequently, droplets diverge in the vicinity of the second converging-deflecting electrode plate 202. However, as discussed earlier, the droplet velocity near the first and third converging-deflecting electrode plates 201 and 203 is slower than the droplet velocity near the second converging-deflecting electrode plate 202, and thus droplets are more greatly influenced by the electric fields near the first and third converging-deflecting electrode plates 201 and 203. For this reason, converging effects win out over diverging effects, and negatively charged particles ultimately converge. The above is thus the converging and deflecting mechanism for negative droplets.

Figure 4D:
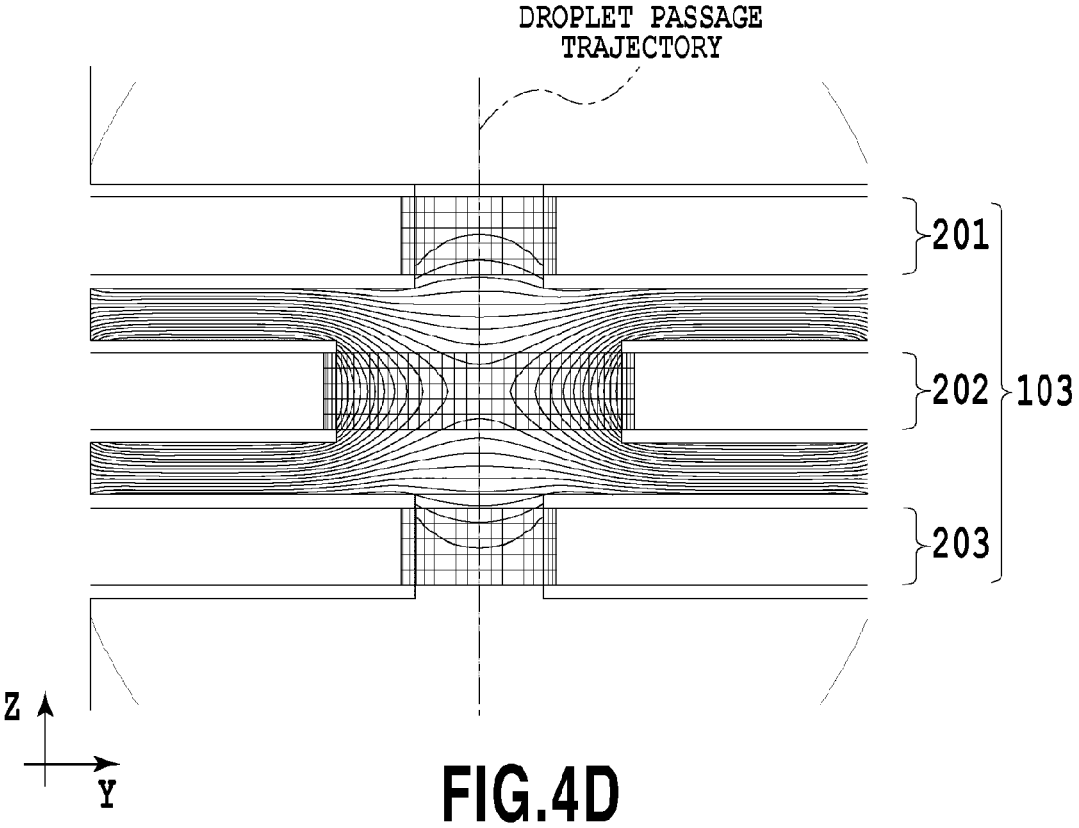
Figure 6B:
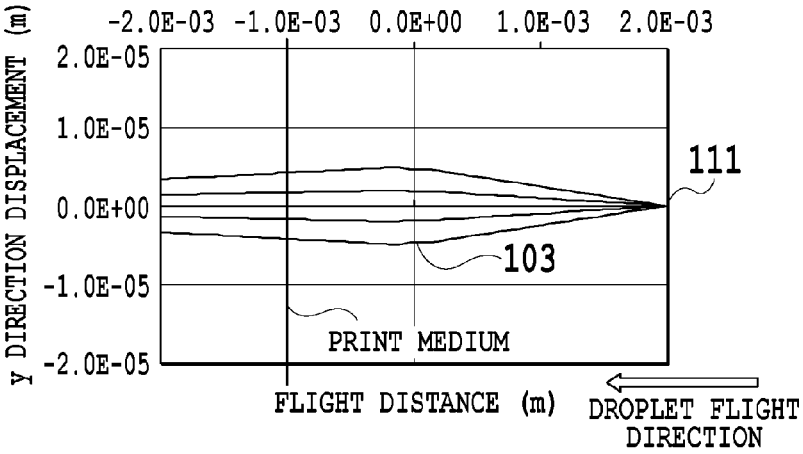

FIG. 4D illustrates equipotential lines on the YZ plane. Since the electrode shapes of the converging-deflecting electrodes are symmetric in the Y direction with respect to the droplet forward trajectory, the produced electric field is also symmetric in the Y direction with respect to the droplet forward trajectory. (b) in FIG. 5 illustrates flight trajectories of negatively charged print droplets in the case where the angle of droplet ejection is shifted −2.5 mrad, −1 mrad, 0 mrad, 1 mrad, and 2.5 mrad in the Y-axis direction with respect to the Z axis. As (b) in FIG. 5 demonstrates, since there is no asymmetric electric field, deflection is not produced. FIG. 6B is a graph of more accurate droplet trajectories. FIG. 6B demonstrates that droplet trajectories are symmetric with respect to the trajectory center, and are also converged by the converging-deflecting electrode 103. If the ejection direction is shifted 2.5 mrad, the landing position is shifted 7.5 μm in the case of no converging-deflecting electrode 103, whereas the shift becomes 4.2 μm due to the effects of the converging-deflecting electrode 103. Similarly, if the ejection direction is shifted 1 mrad, the landing position is shifted 3 μm in the case of no converging-deflecting electrode 103, whereas the shift becomes 1.7 μm due to the effects of the converging-deflecting electrode 103. Although convergence effects in the Y direction are slightly smaller compared to the convergence effects with respect to shifts in the X direction, landing error is reduced to approximately 50%.

Figure 6C:
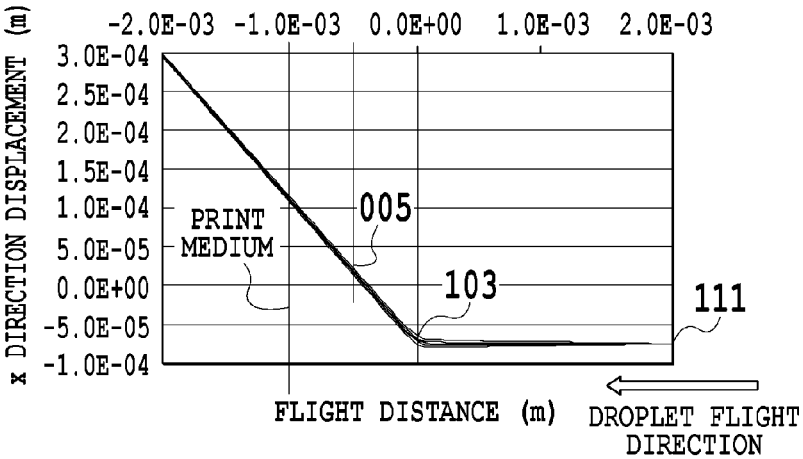

Next, the trajectories of non-print droplets were analyzed. (c) in FIG. 5 illustrates flight trajectories of positively charged non-print droplets in the case where the angle of droplet ejection is shifted −2.5 mrad, −1 mrad, 0 mrad, 1 mrad, and 2.5 mrad in the X-axis direction with respect to the Z axis. (c) in FIG. 5 demonstrates that, unlike a print droplet, a non-print droplet is deflected in the rightwards (+X) direction. FIG. 6C is a graph of more accurate droplet trajectories. A deflection magnitude of approximately 125 μm is obtained at the point 2.5 mm away from a nozzle 111 with a gutter. A print droplet is deflected approximately 60 μm over the same distance, for a differential of 185 μm with respect to a print droplet. This is a sufficient differential for sorting print droplets and non-print droplets.

FIG. 6C also demonstrates that non-print droplets converge similarly to print droplets. More specifically, if the ejection direction is shifted 2.5 mrad, the landing position in the gutter 005 is shifted 6.3 μm in the case of no converging-deflecting electrode 103, whereas the shift becomes 4.1 μm due to the effects of the converging-deflecting electrode 103. Similarly, if the ejection direction is shifted 1 mrad, the landing position in the gutter 005 is shifted 2.5 μm in the case of no converging-deflecting electrode 103, whereas the shift becomes 1.7 μm due to the effects of the converging-deflecting electrode 103. By having convergence effects in this way, collection precision in the gutter 005 can also be raised. This has the effect of preventing uncollected droplets from adhering to the flight channel walls, which can cause blocking and drip, which causes charge to be produced and shifts the droplet trajectory.

The converging-deflecting mechanism for positively charged droplets will now be discussed in further detail. This mechanism differs from the converging of negatively charged droplets discussed earlier. Due to the electric field, a positively charged droplet will decelerate while heading from the first converging-deflecting electrode plate 201 to the second converging-deflecting electrode plate 202, and accelerate while heading from the second converging-deflecting electrode plate 202 to the third converging-deflecting electrode plate 203. Also, if a positively charged droplet is shifted to the right (+X) with respect to the trajectory center as it travels, then the droplet will be subjected to a rightwards (+X) force when passing through near the first converging-deflecting electrode plate 201 and the third converging-deflecting electrode plate 203. In contrast, if the droplet is shifted to the left (−X) as it travels, the droplet will be subjected to a leftwards (−X) force when passing through near the first converging-deflecting electrode plate 201 and the third converging-deflecting electrode plate 203. In other words, droplets scatter and converging effects are not realized by the symmetric electric fields around the first converging-deflecting electrode plate 201 and the third converging-deflecting electrode plate 203. Meanwhile, the droplet will be subjected to a rightwards (+X) force while passing through near the second converging-deflecting electrode plate 202, regardless of its shift from the droplet trajectory. In other words, deflecting effects are realized by the electric field around the second converging-deflecting electrode plate 202, and the direction is the opposite direction of negatively charged droplets. Furthermore, closer observation of the electric field around the second converging-deflecting electrode plate 202 reveals that, given the intervals between equipotential lines, this rightwards (+X) force is weaker at the aperture center. In other words, since the deflection magnitude is greater for droplets farther leftwards (−X), converging effects are realized. As discussed earlier, the velocity of positively charged droplets near the first and third converging-deflecting electrode plates 201 and 203 is faster than the droplet velocity near the second converging-deflecting electrode plate 202. Consequently, droplets are more greatly influenced by the electric field near the second converging-deflecting electrode plate 202. For this reason, converging effects win out over diverging effects, and positively charged particles ultimately converge. Consequently, converging effects for positive droplets are due to the electric field around the second converging-deflecting electrode plate 202, rather than the symmetric electric fields around the first converging-deflecting electrode plate 201 and the third converging-deflecting electrode plate 203.

The above analysis results demonstrate that the converging-deflecting electrode 103 has both converging effects and deflecting effects, and since the deflection magnitude differs according to the charge magnitude, the converging-deflecting electrode 103 is effective as droplet sorting means and has the advantage of improving landing precision.

The converging-deflecting electrode 103 in the present embodiment is formed of three electrode plates, but converging-deflecting effects can be obtained with even two plates, as discussed in a second embodiment. However, droplets accelerate or decelerate when passing through electrodes, as discussed earlier. Consequently, in order to keep droplet velocity unchanged before and after the converging-deflecting electrode 103, it is preferable to have three or more electrodes with equal potentials at the outer electrodes on either side of the droplet forward direction. Furthermore, in order for the outer electrodes to form electric fields with the surrounding members and keep velocity changes and flight direction shifts from occurring in charged droplets, it is preferable for the potential at the outer electrodes to be grounded at 0 V (GND). In other words, if there are three deflecting electrodes as in the present embodiment, droplet velocity is unchanged at the electrode entrance and exit, and in addition, both converging and deflecting effects are obtained.

Figure 7:
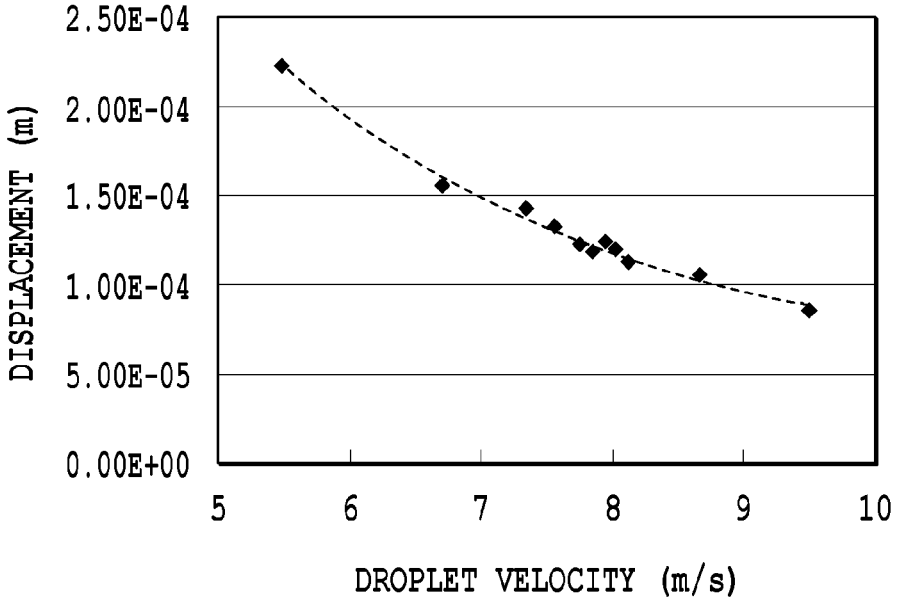
FIG. 7 is a graph illustrating the relationship between droplet velocity and deflection magnitude in a first embodiment of the present invention.

FIG. 7 is a graph of the relationship between the forward velocity toward the converging-deflecting electrode 103 and the deflection magnitude of a print droplet. The deflection magnitude varies according to droplet velocity. For example, for a droplet forward velocity in the range from 5.5 m/s to 9.5 m/s, the deflection magnitude ΔX of a droplet perpendicularly entering the aperture center of the first converging-deflecting electrode plate 201 from the nozzle 111 obtains the relationship $$\Delta X=0.004v^{-1.7} \tag{1}$$

with the droplet forward velocity v. The graph in FIG. 7 demonstrates how the deflection magnitude decreases with faster droplet forward velocities, and increases with slower droplet forward velocities. This is because the time to pass through the converging-deflecting electrode 103 increases inversely proportionally to the velocity, and the time that a droplet is subjected to force from an electric field increases.

Meanwhile, fluctuations in droplet velocity lead to landing time differentials on the print medium, with the landing error being equivalent to the distance the print medium is conveyed during that time. Thus, if the direction in which a print droplet is deflected (the −X direction in the present embodiment) is made to face the same way as the conveyance direction of the print medium, fluctuations in deflection magnitude by the converging-deflecting electrode 103 due to fluctuations in droplet velocity will cancel out the error due to landing time differentials.

For example, take the average droplet flow rate and the entrance velocity into the converging-deflecting electrode 103 to be 8 m/s. In this case, if the droplet flow increases by 1%, then for a flight distance of 3 mm, the landing time occurs 3.71 μs earlier. If the print medium conveyance velocity is taken to be 0.83 m/s, for example, then the landing error due to the landing time differential is −3.09 μm, taking the print medium conveyance direction as negative. Meanwhile, the landing error due to the change in deflection magnitude at the converging-deflecting electrode becomes 1.8 μm. Consequently, the combined landing error from both effects becomes −1.29 μm. The conditions under which the errors from both effects completely cancel out are computed below. The function in Eq. 1 varies according to the charging voltage and the respective voltages and electrode shapes of the converging-deflecting electrode plates, but these can be formularized when the configuration is determined. For this reason, the function in Eq. 1 is generalized as $\Delta X=f(v_{drop})$. Also, if the average droplet velocity is taken to be $V_{drop}$, the distance from the nozzle 111 to sheet is taken to be 1, and the print medium conveyance velocity is taken to be $v_{media}$, then the relationship can be expressed as follows.

$$f(v_{drop}+\Delta v_{drop})-f(v_{drop})=\left(\frac{l}{v_{drop}}-\frac{l}{v_{drop}+\Delta v_{drop}}\right)v_{media} \tag{2}$$

Simplifying the formula for a sufficiently small range of the droplet velocity variation $\Delta V_{drop}$ gives the following.

$$f'(v_{drop})=\frac{lv_{media}}{v_{drop}^2} \tag{3}$$

The above error-canceling effects are obtained if the direction in which print droplets are deflected is made to face the same way as the conveyance direction of the print medium, but more preferably, error-canceling effects are maximized if a balance among $v_{drop}$, l, $v_{media}$, and the voltages of the respective electrodes is determined so as to satisfy Eq. 3. Herein, $f(v_{drop})$ is nearly proportional to the charging voltage and the voltage of the converging-deflecting electrode. This is because the droplet charge magnitude is nearly proportional to the charging voltage, the electric field strength in the converging-deflecting electrode is nearly proportional to the voltage of the converging-deflecting electrode, and the force exerted on charged droplets is proportional to the above two.

Also, the droplet charge magnitude varies according to the charge state of preceding droplets, even if the voltage applied to the charging electrode plate 102 is the same. The cause of this behavior is electrostatic induction due to preceding charged droplets. Thus, fluctuations in droplet charge magnitude can be decreased by predicting the charge magnitude of preceding droplets on the basis of print data, and controlling the voltage applied to the charging electrode plate 102 so as to cancel the electrostatic induction.

Figure 8A:
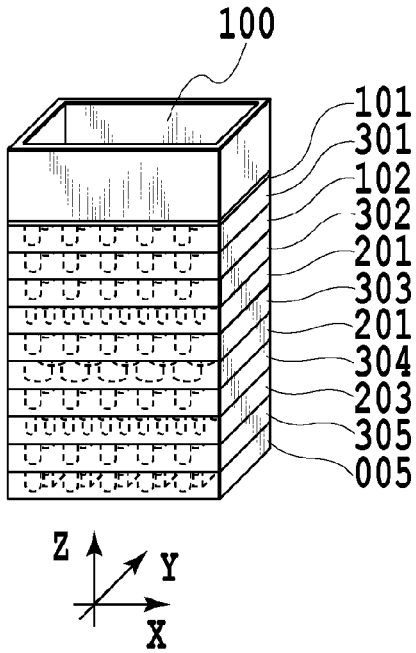
FIGS. 8A and 8B are a perspective view and an exploded perspective view of a droplet ejection head in a first embodiment of the present invention.
Figure 8B:
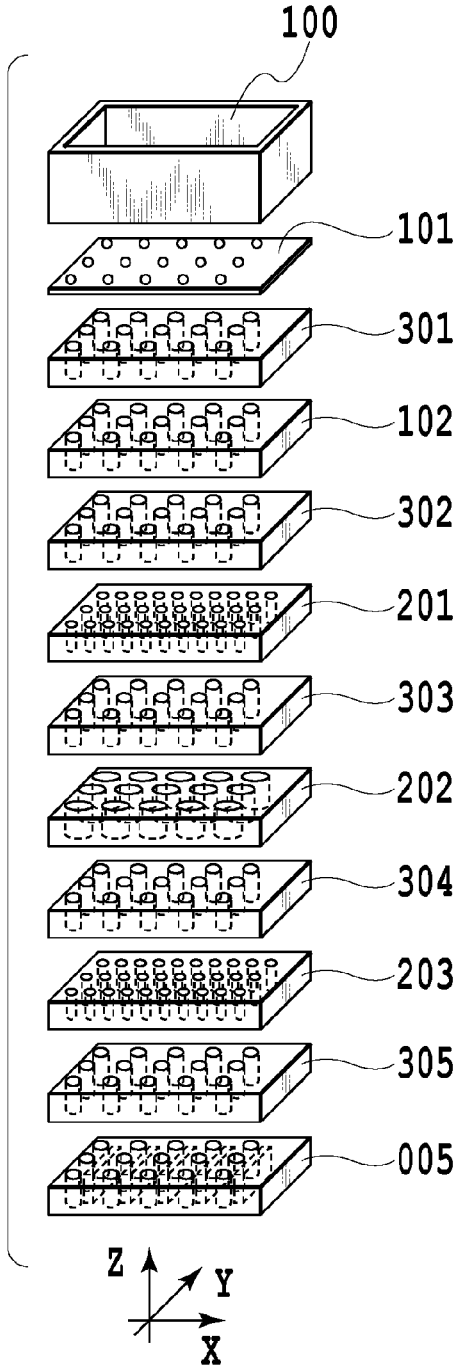

The foregoing thus describes a droplet ejection apparatus provided with a single nozzle 111, but the number of nozzles 111 may also be plural. FIGS. 8A and 8B are a perspective view and an exploded perspective view of a droplet ejection head in accordance with an embodiment of the present invention in the case where the head includes a plurality of nozzles 111. The members constituting the head part are respective planar members, which are stacked in the ink flight direction. An orifice plate 101 abuts a common ink chamber 100. On the orifice plate 101, a plurality of nozzles that eject ink are two-dimensionally arrayed in a first direction and a second direction orthogonal thereto on the principal surface. On the charging electrode plate 102, apertures that allow ejected ink to pass through are provided, and electrodes are additionally formed on the lateral walls of the through holes. The electrodes are coupled to wiring and are configured such that a charging voltage can be individually applied thereto.

On the respective electrode plates 201, 202, and 203 of the converging-deflecting electrode 103, apertures that allow ejected ink to pass through are individually provided. Although it is necessary for the respective electrode plates of the converging-deflecting electrode 103 to be insulated from each other, it is not necessary to individually control voltage on a per-nozzle basis, unlike the electrodes of the charging electrode plate 102. For this reason, the apertures may be coupled to each other by wiring such that the potential is equalized throughout the same electrode plate. Also, by manufacturing the converging-deflecting electrode 103 using conducting members, potential can be equalized throughout each member, and the patterning for electrodes and wiring on each electrode plate may be reduced or omitted. On the gutter 005, there are provided apertures for collecting droplets not used to print from each nozzle 111. Flow channels for sending collected droplets to the collection pump 006 are also provided. Insulating spacers 301, 302, 303, 304, and 305 are respectively provided between the orifice plate 101, the charging electrode plate 102, each of the converging-deflecting electrode plates 201, 202, and 203, and the gutter 005 to maintain an interval therebetween and to insulate electrodes from each other. By constructing the members constituting the head in a planar configuration corresponding to a plurality of nozzles in this way, assembly becomes much simpler than individually providing an electrode plate for each nozzle. Furthermore, since the electrodes corresponding to individual nozzles in the respective electrode plates 201, 202, and 203 of the converging-deflecting electrode 103 may have the same potential, and since individual switching is not required, wiring can be simplified.

Some of the electrodes on the converging-deflecting electrode plates form a symmetric shape with respect to the droplet forward trajectory around the aperture part through which droplets pass, while the remaining electrodes on the converging-deflecting electrode plates form an asymmetric shape with respect to the droplet forward trajectory around the aperture part through which droplets pass. In the present invention herein, the electrode shape around the aperture through which a droplet passes refers to the edge shape (including the lateral aperture walls on the electrode plate) of the conducting part formed so as to enclose the trajectory axis when viewing an electrode plate from the point of intersection between the droplet passage trajectory and the plane that forms the electrode plate. Since apertures corresponding to each nozzle 111 are provided, the shape is asymmetric with respect to a given droplet's forward trajectory when a converging-deflecting electrode plate is viewed as a whole. However, the apertures provided for surrounding nozzles are distant and blocked by interposed electrodes, and exert almost no influence on electric field formation along the entry trajectory for that droplet. In other words, the shape of the electrode around the aperture through which a given droplet passes is crucial to the formation of an electric field near the aperture though which the droplet passes. The flight trajectories of droplets ejected from respective nozzles in the configuration having a plurality of nozzles 111 in FIGS. 8A and 8B are similar to analysis results for a single nozzle that was discussed earlier, with each having converging and deflecting effects.

Second Embodiment

Figure 9:
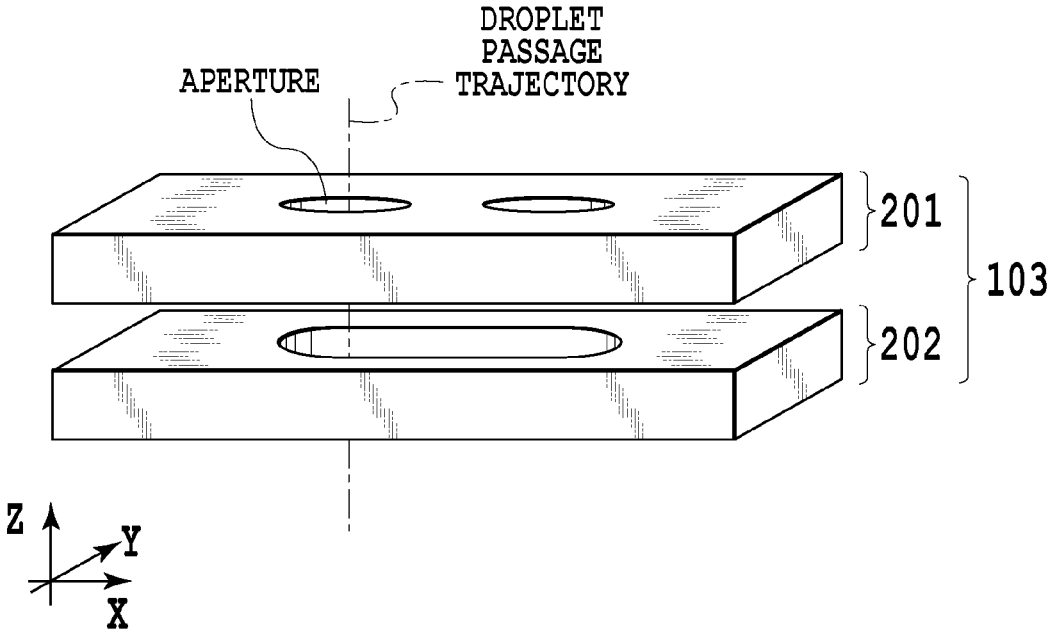
FIG. 9 is a perspective view of a converging-deflecting electrode in a second embodiment of the present invention.

A second embodiment of the present invention will now be described. In the present embodiment, the converging-deflecting electrode 103 is made up of two electrode plates 201 and 202 (FIG. 9). The shape of the first electrode plate 201 is similar to that of the first converging-deflecting electrode plate 201 in the first embodiment illustrated in FIG. 4A, and the shape of the second electrode plate 202 is similar to that of the second converging-deflecting electrode plate 202 in the first embodiment illustrated in FIG. 4B. The disposition and shape of other components such as the nozzle 111 and the charging electrode plate 102 are similar to that of the first embodiment. The operating conditions of the pressure pump 002 and the vibrating mechanism 003 are also similar to those of the first embodiment, with the droplet size similarly being 4 pL and the ejection velocity similarly being approximately 10 m/s but reduced to approximately 8 m/s when passing through the converging-deflecting electrode 103.

If the charging voltage applied to print droplets is taken to be 400V and the charging voltage $V_c$ applied to non-print droplets is taken to be −400 V, the charge magnitude becomes $-6.0\times10^{-13}$ C and $6.0\times10^{-13}$ C, respectively. The converging-deflecting electrode 103 is positioned 2 mm away from the nozzle, and the print medium is positioned 3 mm away from the nozzle.

Figure 10A:
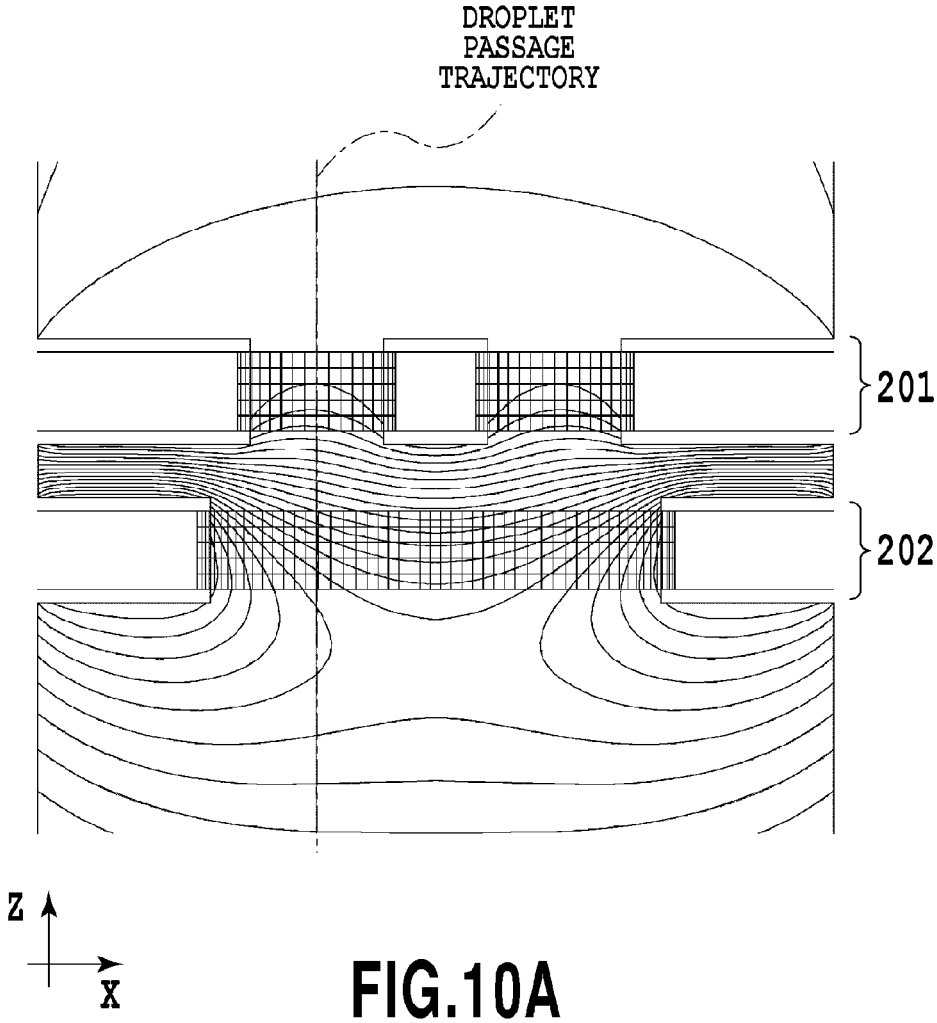
FIGS. 10A to 10C illustrate an electric field and droplet flight trajectories in a second embodiment of the present invention.

Equipotential lines of electric fields in the converging-deflecting electrode and trajectories of charged droplets were simulated while taking the voltage $V_{d1}$ of the first converging-deflecting electrode plate 201 to be 0 V and the voltage $V_{d2}$ of the second converging-deflecting electrode plate 202 to be 100 V. For the simulation, the 3D non-linear electrostatic field analysis software ELFIN (ELF Corporation) was used. FIG. 10A illustrates equipotential lines on the XZ plane. An electric field symmetric with respect to the droplet trajectory axis line is formed around the aperture (gap) in the first converging-deflecting electrode plate 201. In contrast, an electric field asymmetric with respect to the droplet trajectory axis line is formed near the second converging-deflecting electrode plate 202. As described in the embodiments, the symmetry of an electric field depends on whether or not the electrode of an electrode plate (i.e., the aperture shape) is symmetric with respect to the droplet trajectory axis line.

Figure 10B:
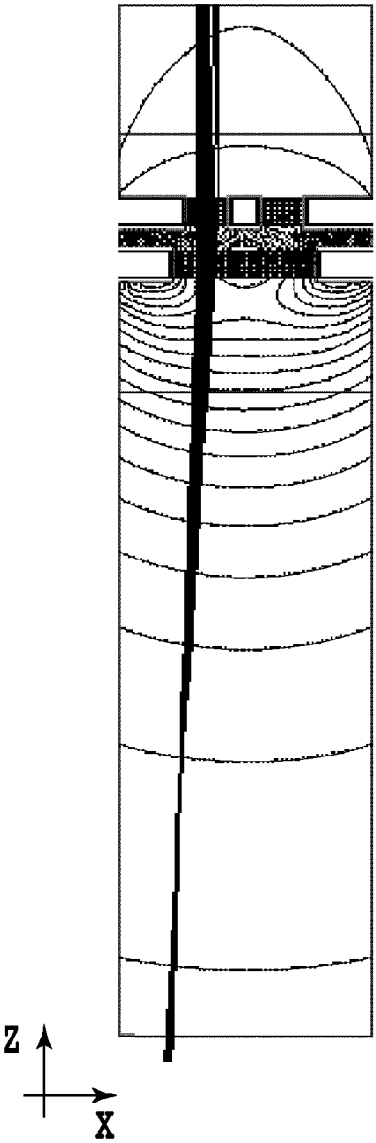
Figure 10C:
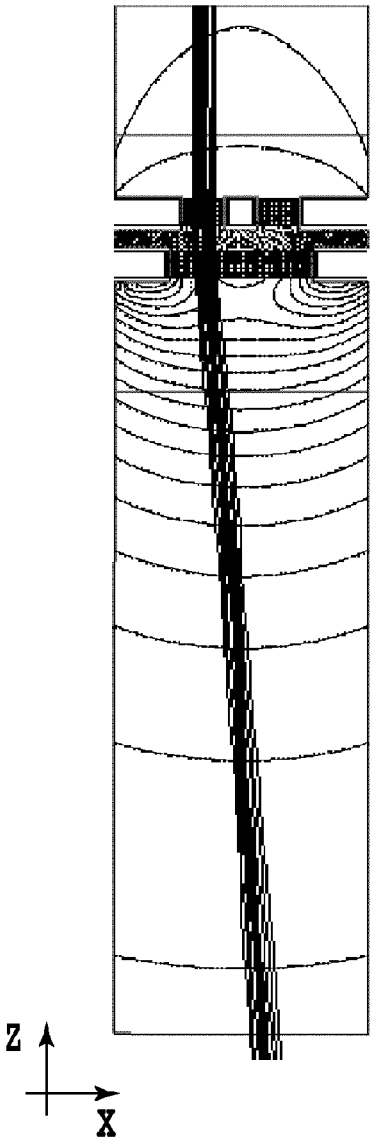

FIG. 10B illustrates flight trajectories of negatively charged print droplets in the case where droplet ejection is shifted −20 μm, −10 μm, 0 μm, 10 μm, and 20 μm from the aperture centerline of the first converging-deflecting electrode plate 201 in the X-axis direction while keeping parallel to the Z axis. As FIG. 10B demonstrates, when droplets pass through the converging-deflecting electrode 103, droplets are deflected to the left (the −X direction) while also converging. Meanwhile, FIG. 10C illustrates the results of similar calculations on flight trajectories of positively charged non-print droplets. FIG. 10C demonstrates that non-print droplets are deflected in the direction opposite that of the print droplets (i.e., the +X direction). A gutter 005 may be provided along the flight trajectories of such non-print droplets.

The above demonstrates that converging and deflecting effects are obtained even in the case where the converging-deflecting electrode 103 is made up of two electrode plates. By providing two electrode plates, the configuration can be simplified. Error due to fluctuations in droplet velocity can also be decreased by making the print droplet deflection direction and the print medium conveyance direction the same, similarly to the first embodiment. Also, the above configuration is applicable to a droplet ejection head provided with a plurality of nozzles 111, similarly to the first embodiment.

Third Embodiment

Figure 11:
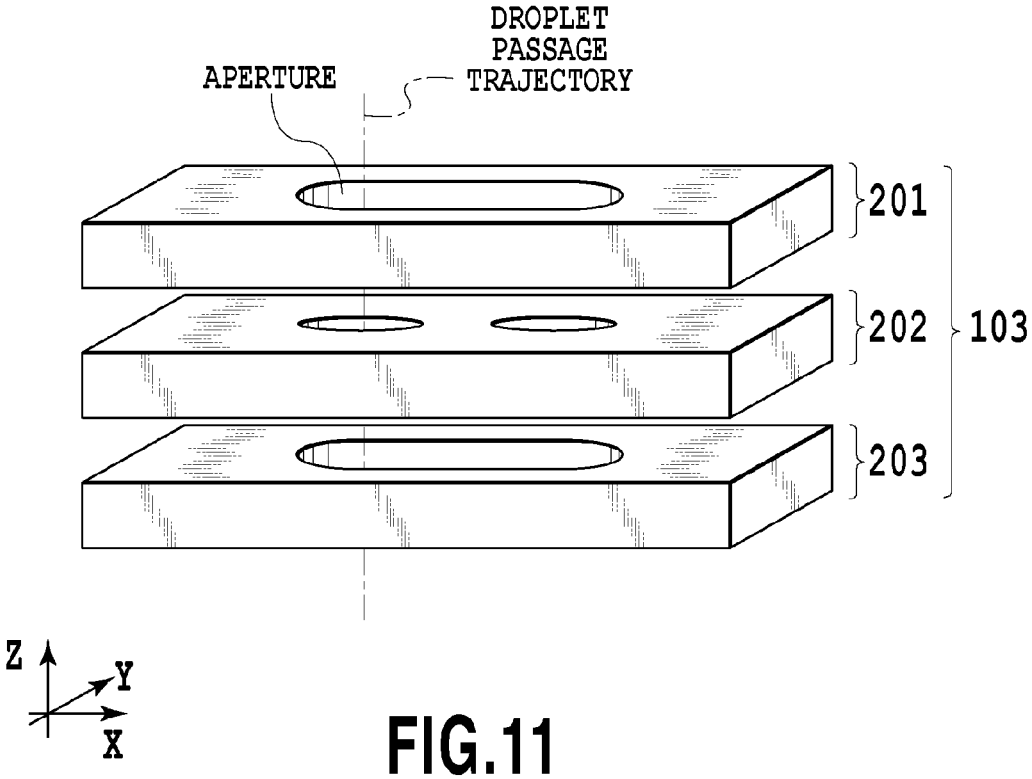
FIG. 11 is a perspective view of a converging-deflecting electrode in a third embodiment of the present invention.

A third embodiment of the present invention will now be described. In the present embodiment, the converging-deflecting electrode 103 is made up of three electrode plates 201, 202, and 203, as illustrated in FIG. 11. The shapes of the first electrode plate 201 and the third electrode plate 203 are similar to that of the second converging-deflecting electrode plate 202 in the first embodiment illustrated in FIG. 4B, while the shape of the second electrode plate 202 is similar to that of the first and third electrode plates 201 and 203 in the first embodiment illustrated in FIG. 4A. In other words, in the present embodiment, the apertures (gaps) in the outer electrode plates 201 and 203 on the Z axis are asymmetric with respect to the droplet forward trajectory, while the aperture in the inner electrode plate 202 is symmetric with respect to the droplet forward trajectory.

The disposition and shape of other components such as the nozzle 111 and the charging electrode plate 102 are similar to that of the first embodiment. The operating conditions of the pressure pump 002 and the vibrating mechanism 003 are also similar to those of the first embodiment, with the droplet size similarly being 4 pL and the ejection velocity similarly being approximately 10 m/s but reduced to approximately 8 m/s when passing through the converging-deflecting electrode 103.

If the charging voltage applied to print droplets is taken to be 400V and the charging voltage $V_c$ applied to non-print droplets is taken to be −400 V, the charge magnitude becomes $-6.0\times10^{-13}$ C and $6.0\times10^{-13}$ C, respectively. The converging-deflecting electrode 103 is positioned 2 mm away from the nozzle, and the print medium is positioned 3 mm away from the nozzle.

Figure 12A:
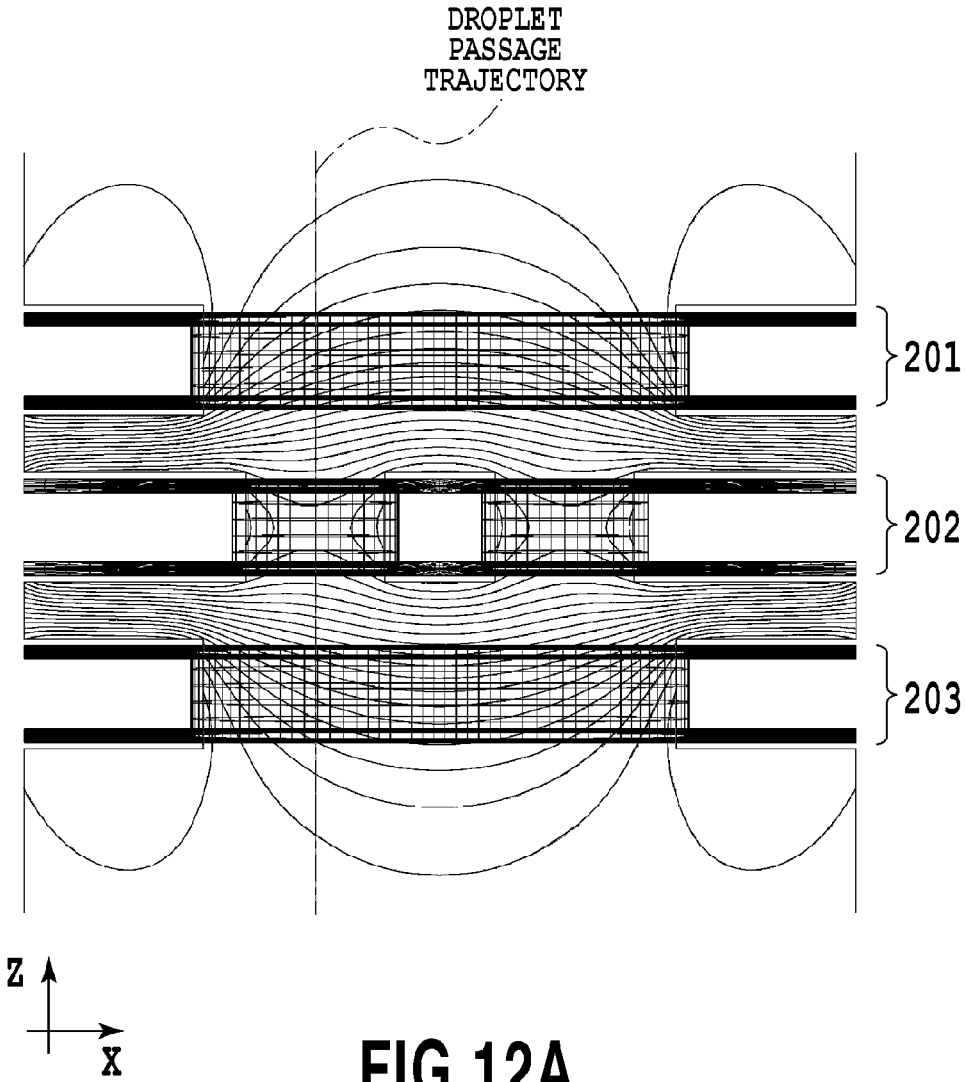
FIGS. 12A to 12C illustrate an electric field and droplet flight trajectories in a third embodiment of the present invention.

Equipotential lines of electric fields in the converging-deflecting electrode and trajectories of charged droplets were simulated while taking the voltage $V_{d1}$ of the first converging-deflecting electrode plate 201 to be 0V, the voltage $V_{d2}$ of the second converging-deflecting electrode plate 202 to be −100 V (reverse polarity of the first embodiment), and the voltage $V_{d3}$ of the third converging-deflecting electrode plate 203 to be 0 V. For the simulation, the 3D non-linear electrostatic field analysis software ELFIN (ELF Corporation) was used. FIG. 12A illustrates equipotential lines on the XZ plane. An electric field symmetric with respect to the droplet forward trajectory is formed around the second converging-deflecting electrode plate 202. In contrast, electric fields asymmetric with respect to the droplet forward trajectory are formed near the apertures in the first converging-deflecting electrode plate 201 and the third converging-deflecting electrode plate 203. As described in the embodiments, the symmetry of an electric field depends on whether or not the electrode of an electrode plate (i.e., the aperture shape) is symmetric with respect to the droplet trajectory.

Figure 12B:
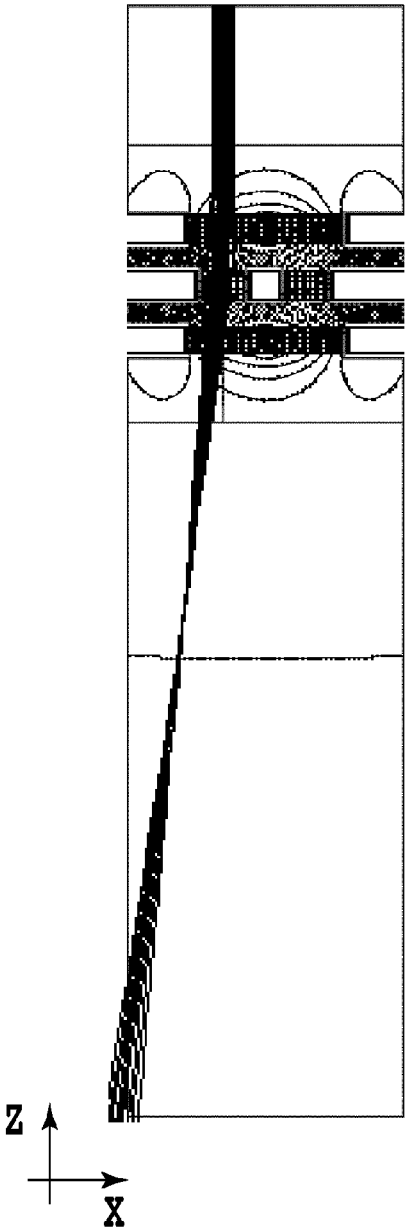
Figure 12C:
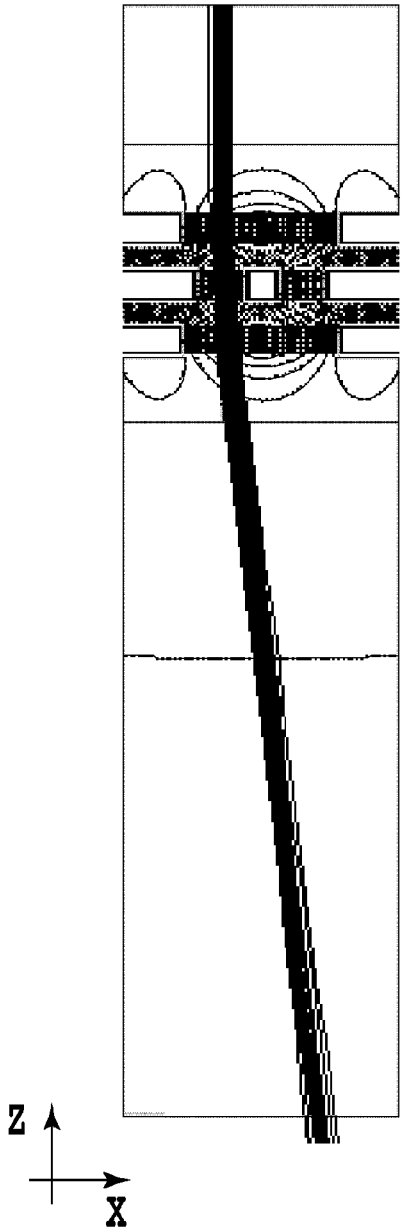

FIG. 12B illustrates flight trajectories of negatively charged print droplets in the case where droplet ejection is shifted −20 μm, −10 μm, 0 μm, 10 μm, and 20 μm from the aperture centerline of the first converging-deflecting electrode plate 201 in the X-axis direction while keeping parallel to the Z axis. As FIG. 12B demonstrates, when droplets pass through the converging-deflecting electrode 103, droplets are deflected to the left (the −X direction) while also converging. Meanwhile, FIG. 12C illustrates the results of similar calculations on flight trajectories of positively charged non-print droplets. FIG. 12C demonstrates that non-print droplets are deflected in the direction opposite that of the print droplets (i.e., the +X direction). A gutter 005 may be provided along the flight trajectories of such non-print droplets.

The above demonstrates that converging and deflecting effects are obtained even in the case of modifying the number and order of symmetric electrode plates and asymmetric electrode plates with respect to the droplet trajectory from among a plurality of electrode plates constituting the converging-deflecting electrode 103. Error due to fluctuations in droplet velocity can also be decreased by making the print droplet deflection direction and the print medium conveyance direction the same, similarly to the first embodiment. Also, the above configuration is applicable to a droplet ejection head provided with a plurality of nozzles 111, similarly to the first embodiment.

Fourth Embodiment

Figure 13:
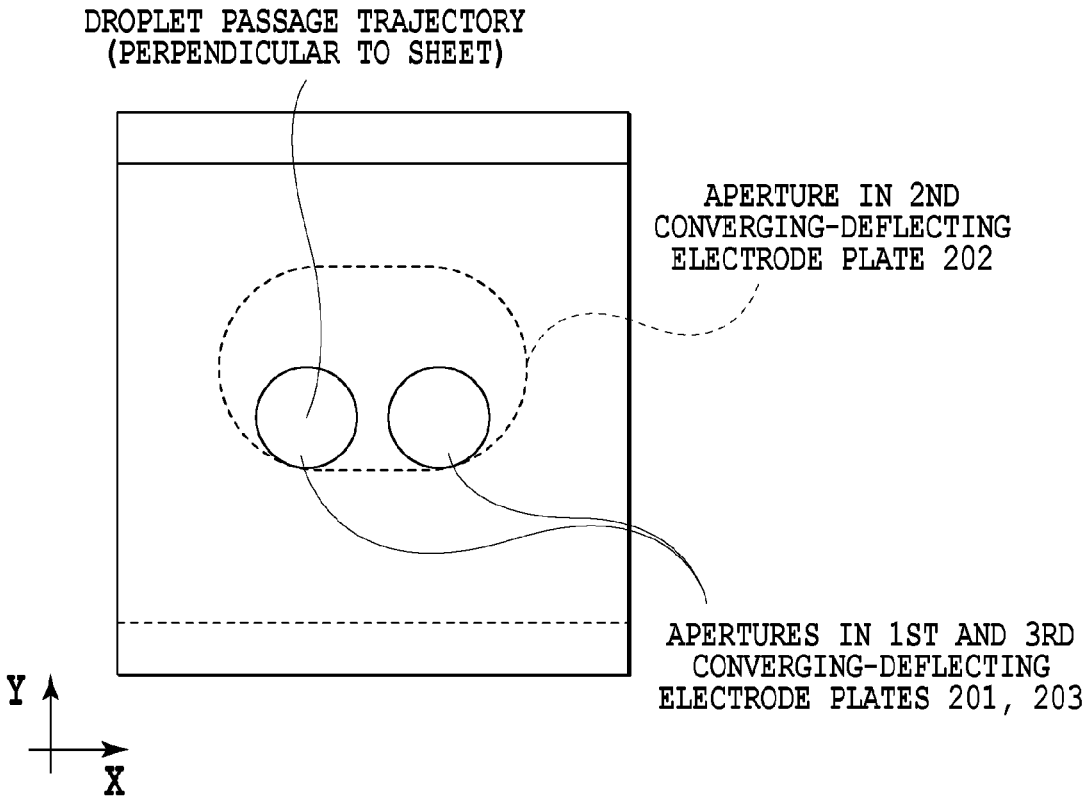
FIG. 13 is a top view of a converging-deflecting electrode plate in a fourth embodiment of the present invention.

A fourth embodiment of the present invention will now be described. In the present embodiment, the converging-deflecting electrode 103 is made up of three electrode plates 201, 202, and 203. The shapes of the first electrode plate 201 and the third electrode plate 203 are similar to that of the first and third converging-deflecting electrode plates 201 and 203 in the first embodiment illustrated in FIG. 4A, while the shape of the second electrode plate 202 is similar to that of the second converging-deflecting electrode plate 202 in the first embodiment illustrated in FIG. 4B. However, as illustrated in the top view of the converging-deflecting electrode 103 in FIG. 13, the second converging-deflecting electrode plate 202 is positioned with a 50 μm shift in the +Y direction compared to the other electrode plates 201 and 203. In so doing, the electrodes near the aperture (gap) in the second converging-deflecting electrode plate 202 become asymmetric with respect to the droplet flight trajectory in not only the X direction, but also in the Y direction.

The disposition and shape of other components such as the nozzle 111 and the charging electrode plate 102 are similar to that of the first embodiment. The operating conditions of the pressure pump 002 and the vibrating mechanism 003 are also similar to those of the first embodiment, with the droplet size similarly being 4 pL and the ejection velocity similarly being approximately 10 m/s but reduced to approximately 8 m/s when passing through the converging-deflecting electrode 103.

If the charging voltage applied to print droplets is taken to be 400V and the charging voltage $V_c$ applied to non-print droplets is taken to be −400 V, the charge magnitude becomes $-6.0\times10^{-13}$ C and $6.0\times10^{-13}$ C, respectively. The converging-deflecting electrode 103 is positioned 2 mm away from the nozzle, and the print medium is positioned 3 mm away from the nozzle.

Figure 14A:
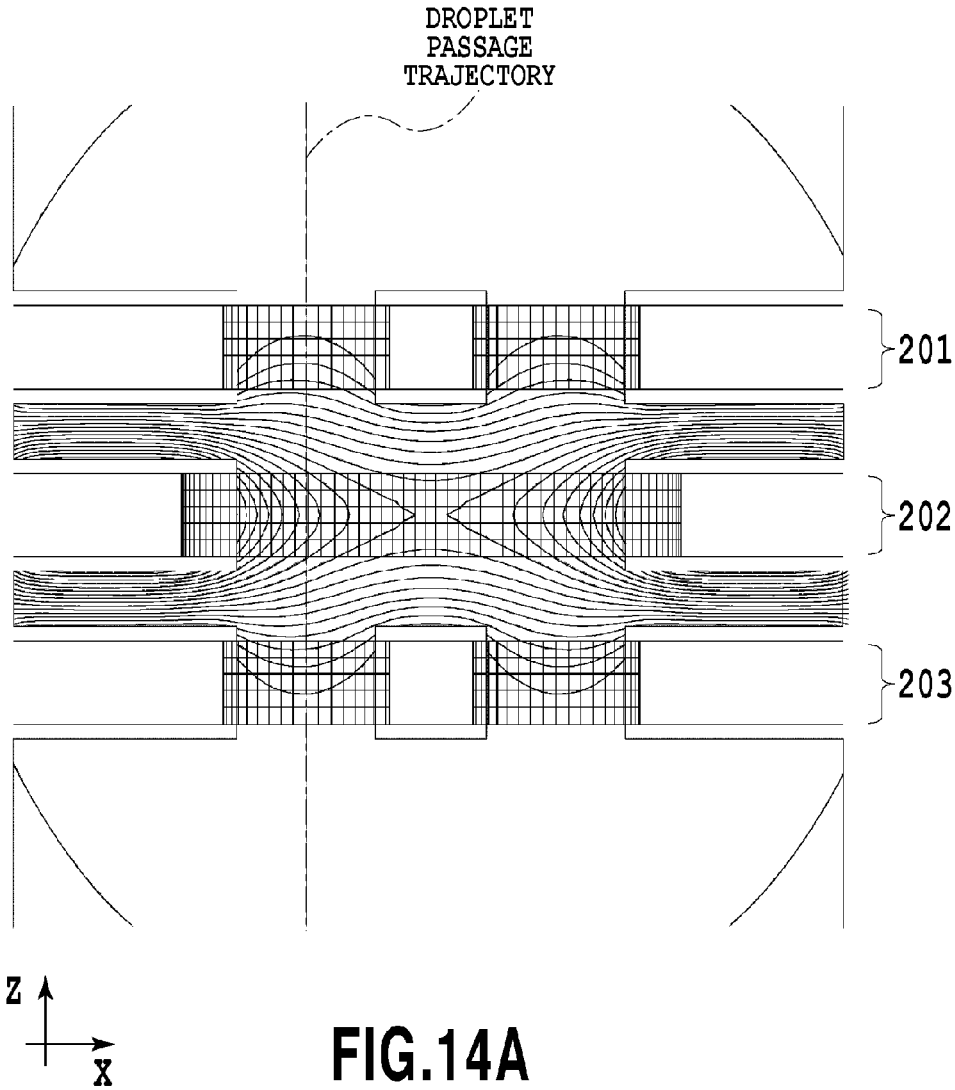
FIGS. 14A and 14B illustrate the electric field of a converging-deflecting electrode in a fourth embodiment of the present invention.
Figure 14B:
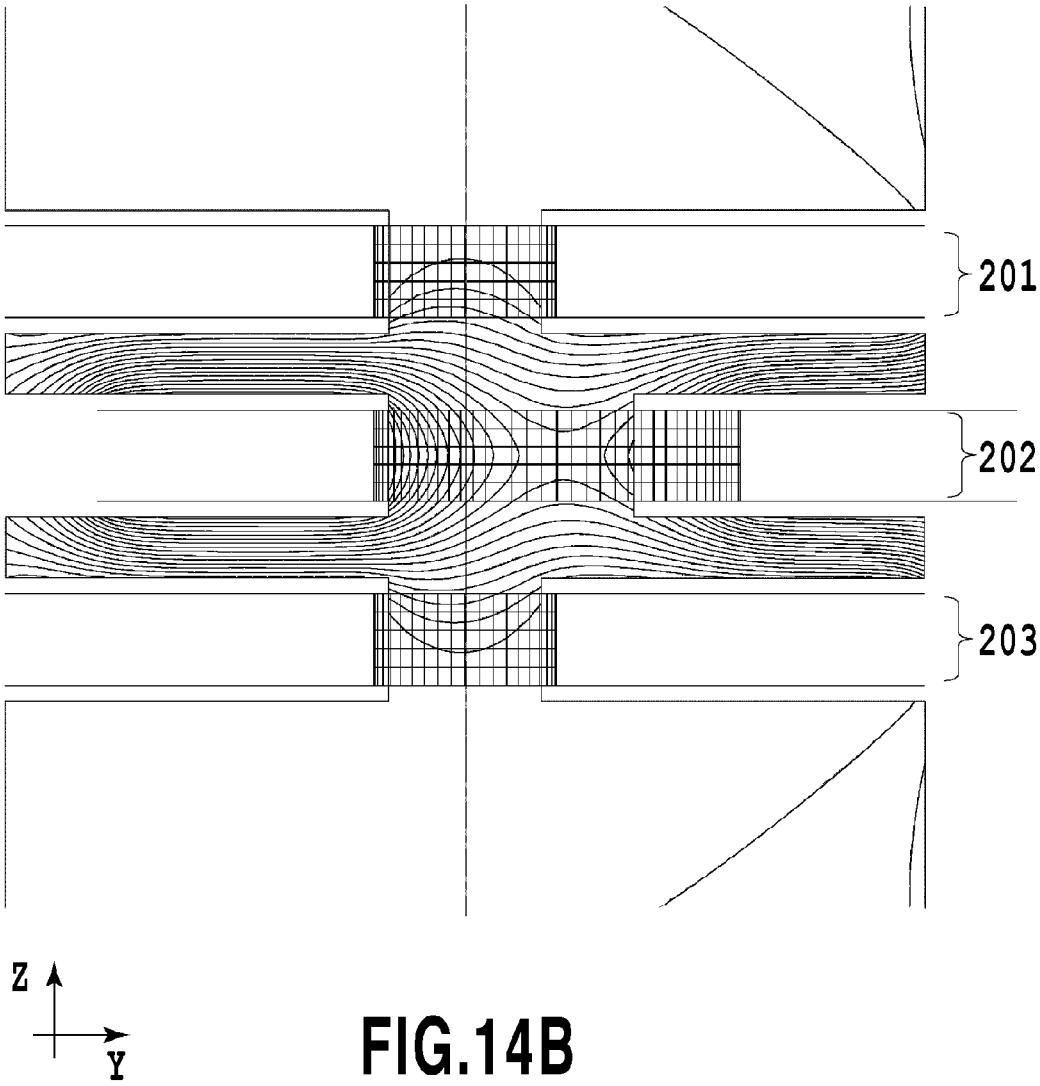

Equipotential lines of electric fields in the converging-deflecting electrode and trajectories of charged droplets were simulated while taking the voltage $V_{d1}$ of the first converging-deflecting electrode plate 201 to be 0V, the voltage $V_{d2}$ of the second converging-deflecting electrode plate 202 to be 100 V, and the voltage $V_{d3}$ of the third converging-deflecting electrode plate 203 to be 0 V. For the simulation, the 3D non-linear electrostatic field analysis software ELFIN (ELF Corporation) was used. FIG. 14A illustrates equipotential lines on the XZ plane. Electric fields symmetric with respect to the droplet forward trajectory are formed around the first converging-deflecting electrode plate 201 and the third converging-deflecting electrode plate 203. In contrast, an electric field asymmetric with respect to the droplet forward trajectory is formed near the aperture in the second converging-deflecting electrode plate 202. This is similar to the analysis results in the first embodiment. Meanwhile, FIG. 14B illustrates equipotential lines on the YZ plane. In the Y direction, the aperture shapes on the first converging-deflecting electrode plate 201 and the third converging-deflecting electrode plate 203 are still symmetric with respect to the droplet forward trajectory, but the aperture shape on the second converging-deflecting electrode plate 202 is asymmetric. For this reason, the equipotential lines are also asymmetric with respect to the droplet forward direction around the second converging-deflecting electrode plate 202 in the YZ plane.

Figure 15A:
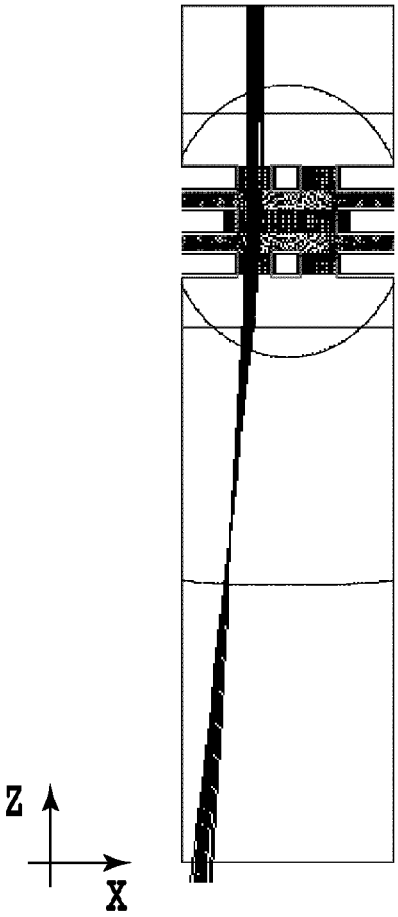
FIGS. 15A to 15D are graphs illustrating droplet flight trajectories in a fourth embodiment of the present invention.
Figure 15C:
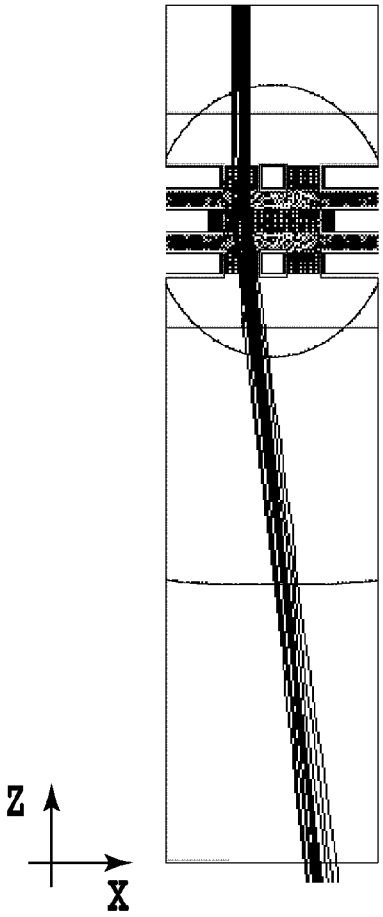
Figure 15B:
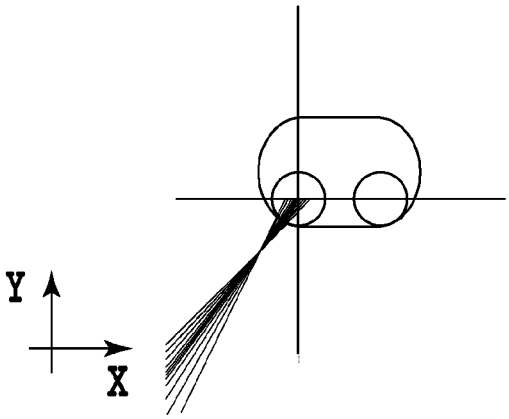

FIGS. 15A and 15B illustrate flight trajectories of negatively charged print droplets in the case where droplet ejection is shifted −20 μm, −10 μm, 0 μm, 10 μm, and 20 μm from the aperture centerline of the first converging-deflecting electrode plate 201 in the X-axis direction while keeping parallel to the Z axis. As FIGS. 15A and 15B demonstrate, when droplets pass through the converging-deflecting electrode 103 from the front view seen from the −Y direction (FIG. 15A), droplets are deflected to the left (the −X direction) while also converging. Additionally, a top view seen from the +Z direction (FIG. 15B) demonstrates that droplets converge while being deflected not only in the X direction, but also in the Y direction. This is an effect of making the second converging-deflecting electrode plate 202 asymmetric with respect to the droplet forward trajectory in the Y direction as well as the X direction.

Figure 15D:
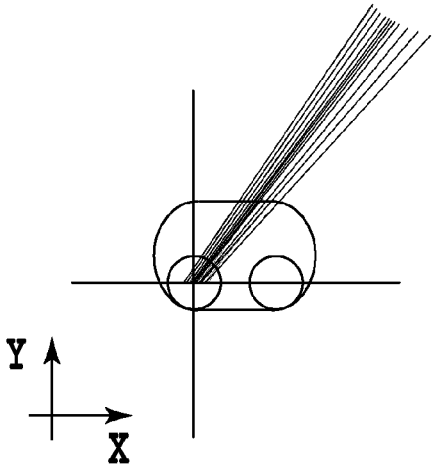

Meanwhile, FIGS. 15C and 15D illustrate the results of conducting similar calculations on flight trajectories of positively charged non-print droplets. A front view seen from the −Y direction (FIG. 15C) demonstrates that non-print droplets are deflected in the direction opposite that of the print droplets (i.e., the +X direction). Additionally, a top view seen from the +Z direction (FIG. 15D) demonstrates that non-print droplets are deflected in the direction opposite that of the print droplets in not only the X direction, but also in the Y direction. This is also an effect of making the second converging-deflecting electrode plate 202 asymmetric with respect to the droplet forward trajectory in the Y direction as well as the X direction. A gutter 005 may be provided along the flight trajectories of such non-print droplets.

The above demonstrates that by making an electrode asymmetric with respect to the droplet trajectory in the Y-axis direction as well as the X-axis direction, droplets can be additionally deflected in the Y direction while still having converging functions. Error due to fluctuations in droplet velocity can also be decreased by making the print droplet deflection direction and the print medium conveyance direction the same, similarly to the first embodiment. Also, the above configuration is applicable to a droplet ejection head provided with a plurality of nozzles 111, similarly to the first embodiment.

Fifth Embodiment

Figure 16:
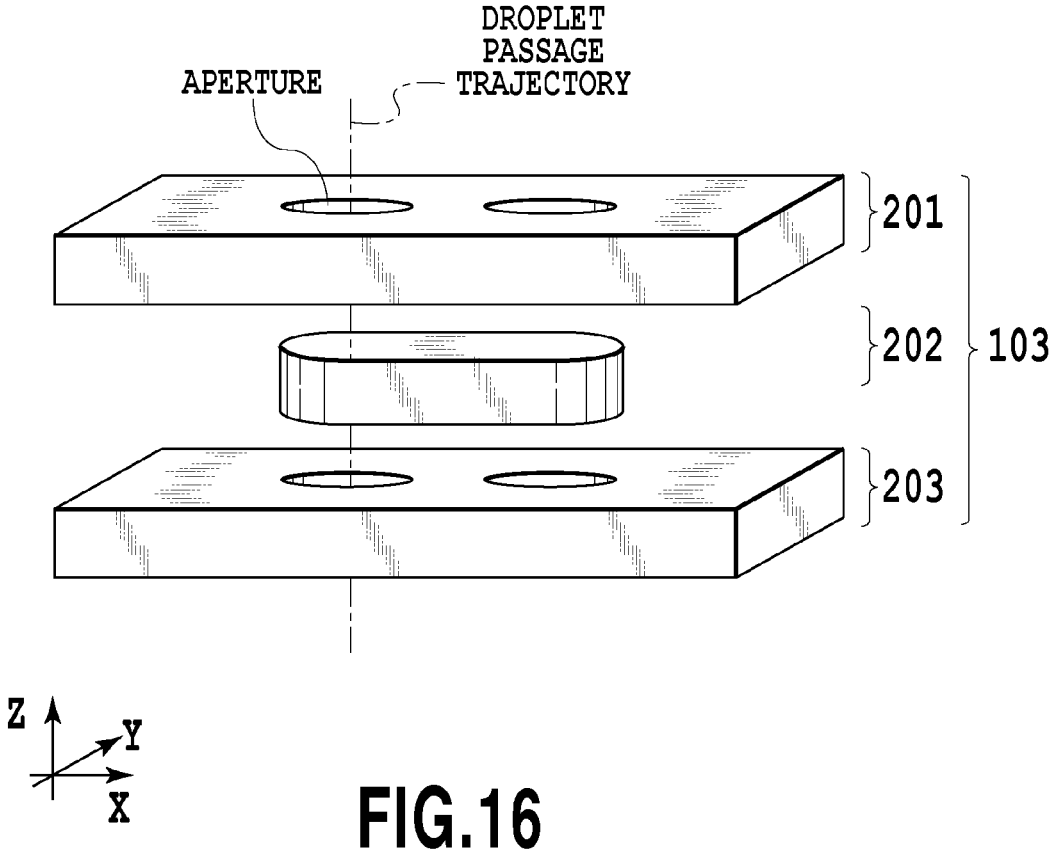
FIG. 16 is a perspective view of a converging-deflecting electrode in a fifth embodiment of the present invention.

A fifth embodiment of the present invention will now be described. In the present embodiment, the converging-deflecting electrode 103 is made up of three electrode plates 201, 202, and 203, as illustrated in FIG. 16. The shapes of the first electrode plate 201 and the third electrode plate 203 are similar to that of the first and third converging-deflecting electrode plates 201 and 203 in the first embodiment illustrated in FIG. 4A. The shape of the second electrode plate 202 is configured such that an electrode is formed only on the lateral walls of the aperture (gap) in the second converging-deflecting electrode plate 202 in the first embodiment illustrated in FIG. 4B.

The disposition and shape of other components such as the nozzle 111 and the charging electrode plate 102 are similar to that of the first embodiment. The operating conditions of the pressure pump 002 and the vibrating mechanism 003 are also similar to those of the first embodiment, with the droplet size similarly being 4 pL and the ejection velocity similarly being approximately 10 m/s but reduced to approximately 8 m/s when passing through the converging-deflecting electrode 103.

If the charging voltage applied to print droplets is taken to be 400V and the charging voltage $V_c$ applied to non-print droplets is taken to be −400 V, the charge magnitude becomes $-6.0\times10^{-13}$ C and $6.0\times10^{-13}$ C, respectively. The converging-deflecting electrode 103 is positioned 2 mm away from the nozzle, and the print medium is positioned 3 mm away from the nozzle.

Figure 17A:
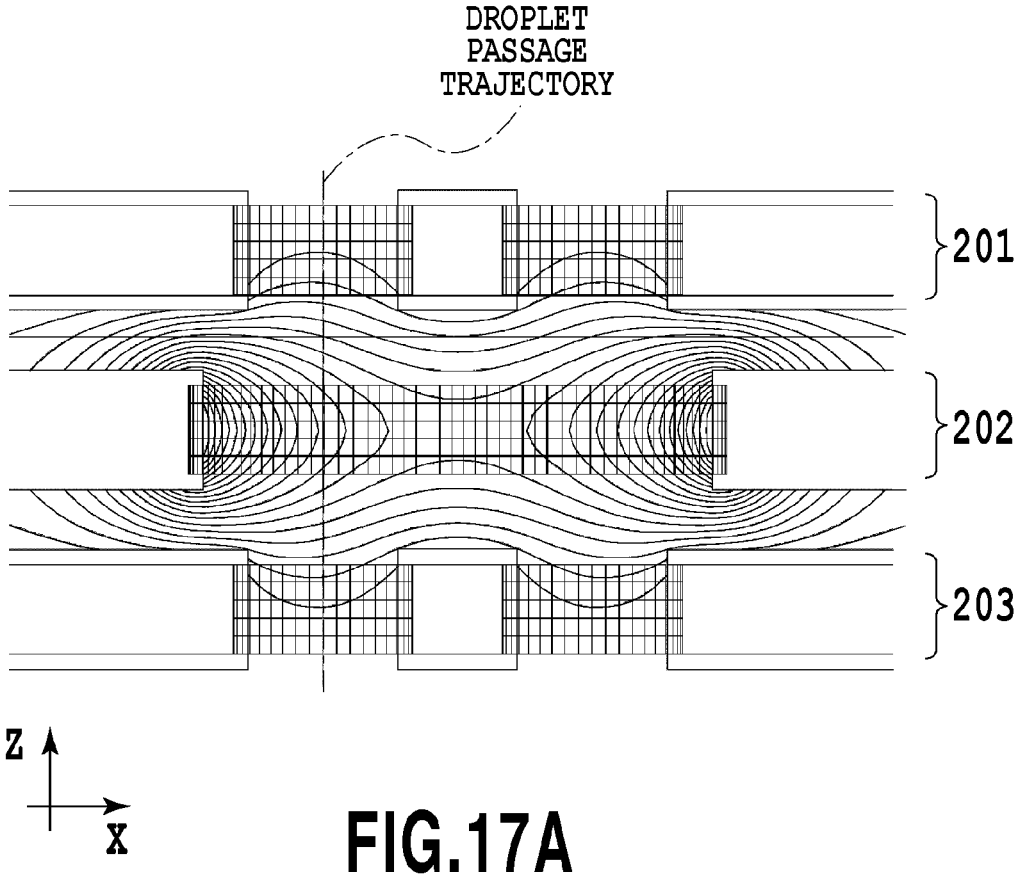
FIGS. 17A to 17C illustrate an electric field and droplet flight trajectories in a fifth embodiment of the present invention.

Equipotential lines of electric fields in the converging-deflecting electrode and trajectories of charged droplets were simulated while taking the voltage $V_{d1}$ of the first converging-deflecting electrode plate 201 to be 0V, the voltage $V_{d2}$ of the second converging-deflecting electrode plate 202 to be 100 V, and the voltage $V_{d3}$ of the third converging-deflecting electrode plate 203 to be 0 V. For the simulation, the 3D non-linear electrostatic field analysis software ELFIN (ELF Corporation) was used. FIG. 17A illustrates equipotential lines on the XZ plane. Electric fields symmetric with respect to the droplet forward trajectory are formed around the first converging-deflecting electrode plate 201 and the third converging-deflecting electrode plate 203. In contrast, an electric field asymmetric with respect to the droplet forward trajectory is formed near the aperture in the second converging-deflecting electrode plate 202. This is similar to the analysis results in the first embodiment.

Figure 17B:
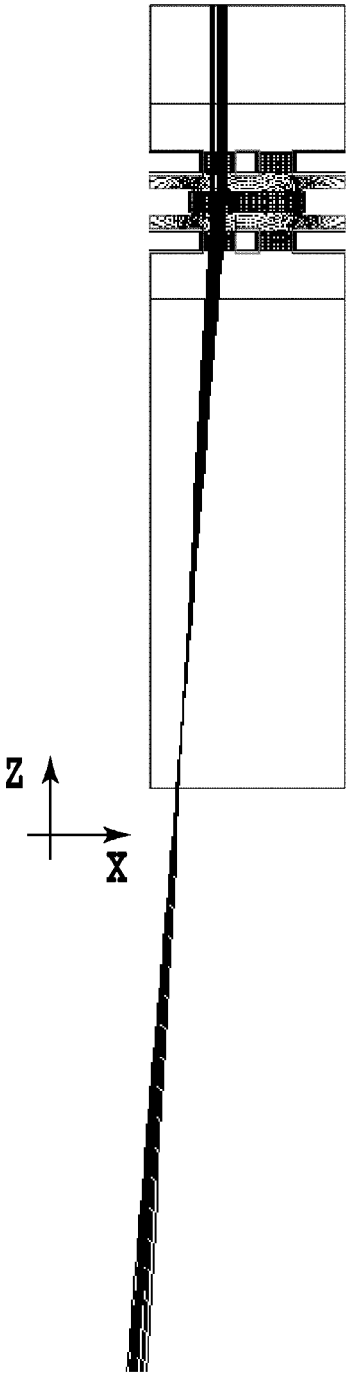

FIG. 17B illustrates flight trajectories of negatively charged print droplets in the case where droplet ejection is shifted −20 μm, −10 μm, 0 μm, 10 μm, and 20 μm from the aperture centerline of the first converging-deflecting electrode plate 201 in the X-axis direction while keeping parallel to the Z axis. FIG. 17B demonstrates how droplets converge while being deflected (in the −X direction).

Figure 17C:
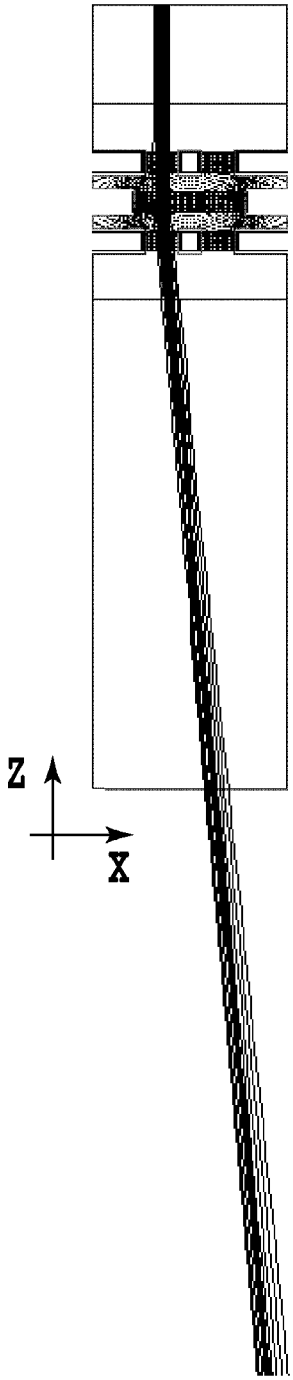

Meanwhile, FIG. 17C illustrates the results of conducting similar calculations on flight trajectories of positively charged non-print droplets. FIG. 17C demonstrates that non-print droplets are deflected in the direction opposite that of the print droplets (i.e., the +X direction). A gutter 005 may be provided along the flight trajectories of such non-print droplets.

The above demonstrates that there are effects even when an electrode of the converging-deflecting electrode 103 is formed on the inner peripheral surface of an aperture rather than on the surface of an electrode plate. Error due to fluctuations in droplet velocity can also be decreased by making the print droplet deflection direction and the print medium conveyance direction the same, similarly to the first embodiment. Also, the above configuration is applicable to a droplet ejection head provided with a plurality of nozzles 111, similarly to the first embodiment.

Sixth Embodiment

Figure 18:
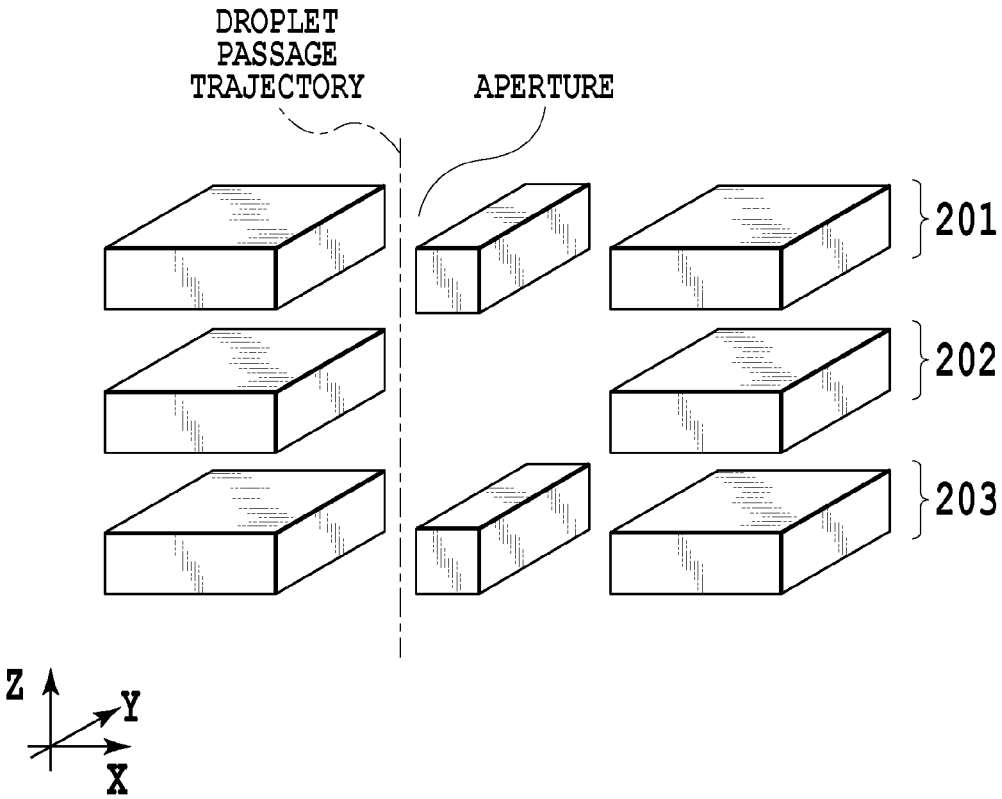
FIG. 18 is a perspective view of a converging-deflecting electrode in a sixth embodiment of the present invention.

A sixth embodiment of the present invention will now be described. In the present embodiment, the converging-deflecting electrode 103 is made up of three electrode plates 201, 202, and 203, as illustrated in FIG. 18. Apertures (gaps) provided in the converging-deflecting electrode 103 of the present embodiment are slit-shaped. Although the individual electrodes of the converging-deflecting electrode 103 in FIG. 18 are respectively made up of a plurality of components, the same voltage value is applied to each component on the same electrode plate.

The electrode shapes of the first and third converging-deflecting electrode plates 201 and 203 have a thickness of 50 μm, with a slit-shaped aperture 100 mm wide running in the Y-axis direction. The droplet flight trajectory is parallel to the Y axis, and passes through a position equidistant from either wall of the slit. In contrast, the electrode shape of the second converging-deflecting electrode plate 202 has a slit-shaped aperture 300 μm wide running in the Y-axis direction, with the droplet trajectory passing through a position 100 μm away from one wall of the slit, and 200 μm away from the other wall. In other words, the electrode shapes of the first and third converging-deflecting electrode plates 201 and 203 are symmetric with respect to the droplet trajectory in the X-axis direction, whereas the electrode shape of the second converging-deflecting electrode plate 202 is asymmetric.

The disposition and shape of other components such as the nozzle 111 and the charging electrode plate 102 are similar to that of the first embodiment. The operating conditions of the pressure pump 002 and the vibrating mechanism 003 are also similar to those of the first embodiment, with the droplet size similarly being 4 pL and the ejection velocity similarly being approximately 10 m/s but reduced to approximately 8 m/s when passing through the converging-deflecting electrode 103.

If the charging voltage applied to print droplets is taken to be 400V and the charging voltage $V_c$ applied to non-print droplets is taken to be −400 V, the charge magnitude becomes $-6.0\times10^{-13}$ C and $6.0\times10^{-13}$ C, respectively. The converging-deflecting electrode 103 is positioned 2 mm away from the nozzle, and the print medium is positioned 3 mm away from the nozzle.

Figure 19A:
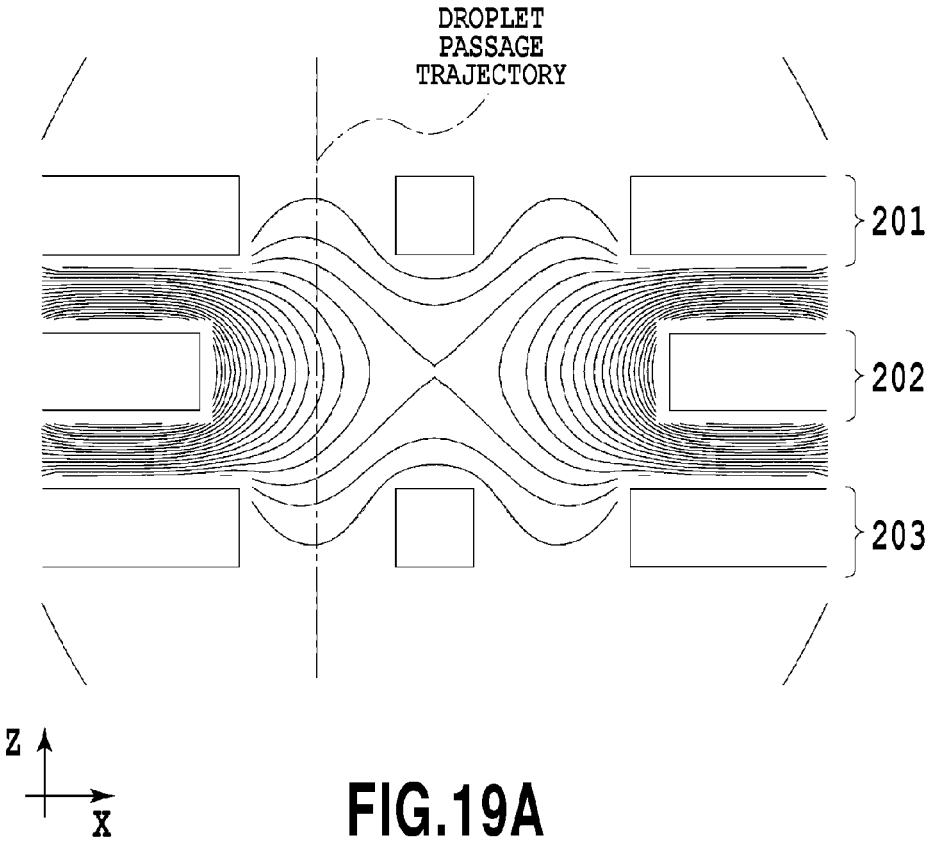
FIGS. 19A to 19C illustrate an electric field and droplet flight trajectories in a sixth embodiment of the present invention.

Equipotential lines of electric fields in the converging-deflecting electrode and trajectories of charged droplets were simulated while taking the voltage $V_{d1}$ of the first converging-deflecting electrode plate 201 to be 0V, the voltage $V_{d2}$ of the second converging-deflecting electrode plate 202 to be 100 V, and the voltage $V_{d3}$ of the third converging-deflecting electrode plate 203 to be 0 V. For the simulation, the 3D non-linear electrostatic field analysis software ELFIN (ELF Corporation) was used. FIG. 19A illustrates equipotential lines on the XZ plane. Electric fields symmetric with respect to the droplet forward trajectory are formed around the first converging-deflecting electrode plate 201 and the third converging-deflecting electrode plate 203. In contrast, an electric field asymmetric with respect to the droplet forward trajectory is formed near the aperture in the second converging-deflecting electrode plate 202. This is similar to the analysis results in the first embodiment.

Figure 19B:
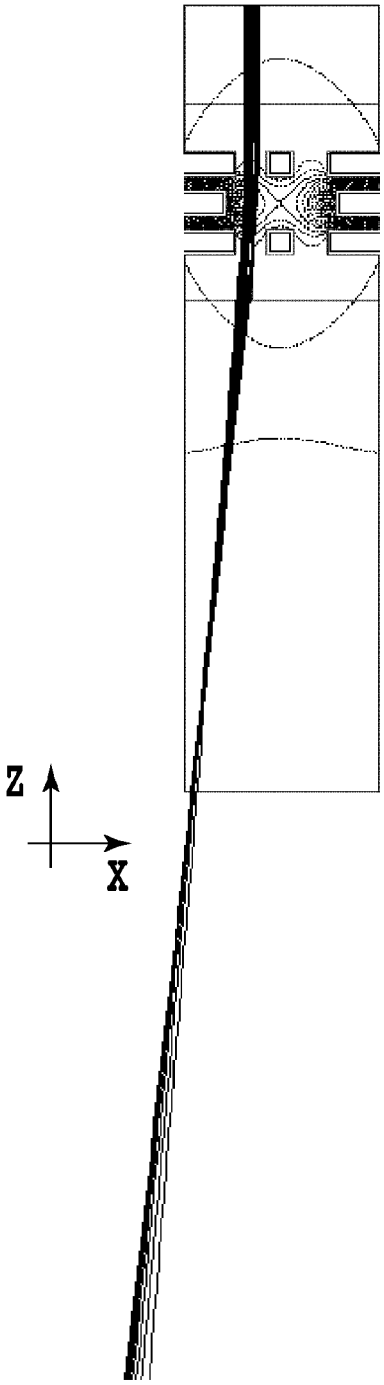
Figure 19C:
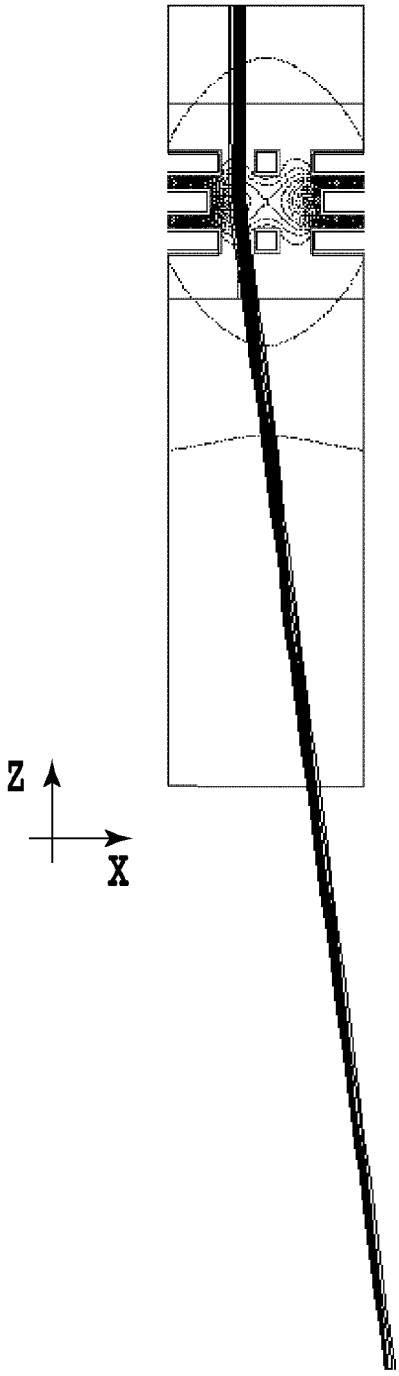

FIG. 19B illustrates flight trajectories of negatively charged print droplets in the case where droplet ejection is shifted −20 μm, −10 μm, 0 μm, 10 μm, and 20 μm from the aperture centerline of the first converging-deflecting electrode plate 201 in the X-axis direction while keeping parallel to the Z axis. FIG. 19B demonstrates how droplets converge while being deflected (in the −X direction). Meanwhile, FIG. 19C illustrates the results of conducting similar calculations on flight trajectories of positively charged non-print droplets. FIG. 19C demonstrates that non-print droplets are deflected in the direction opposite that of the print droplets (i.e., the +X direction). A gutter 005 may be provided along the flight trajectories of such non-print droplets. The above demonstrates that there are converging and deflecting effects even when apertures in electrodes of the converging-deflecting electrode 103 are slit-shaped. However, since electric fields having a lens effect are not formed, converging effects are not obtained with respect to the Y direction in the present embodiment.

Figure 20A:
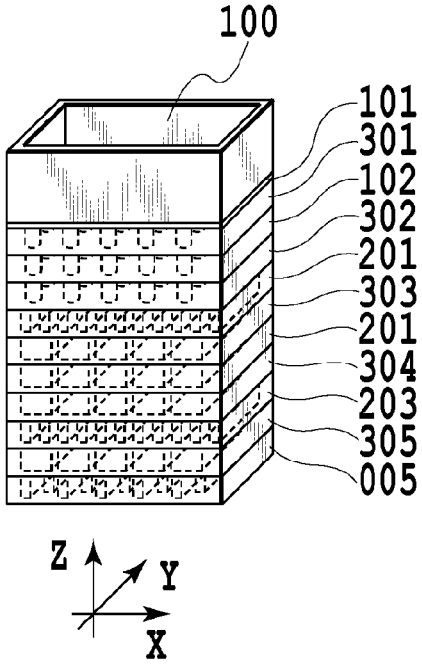
FIGS. 20A and 20B are a perspective view and an exploded perspective view of a droplet ejection head in a sixth embodiment of the present invention.
Figure 20B:
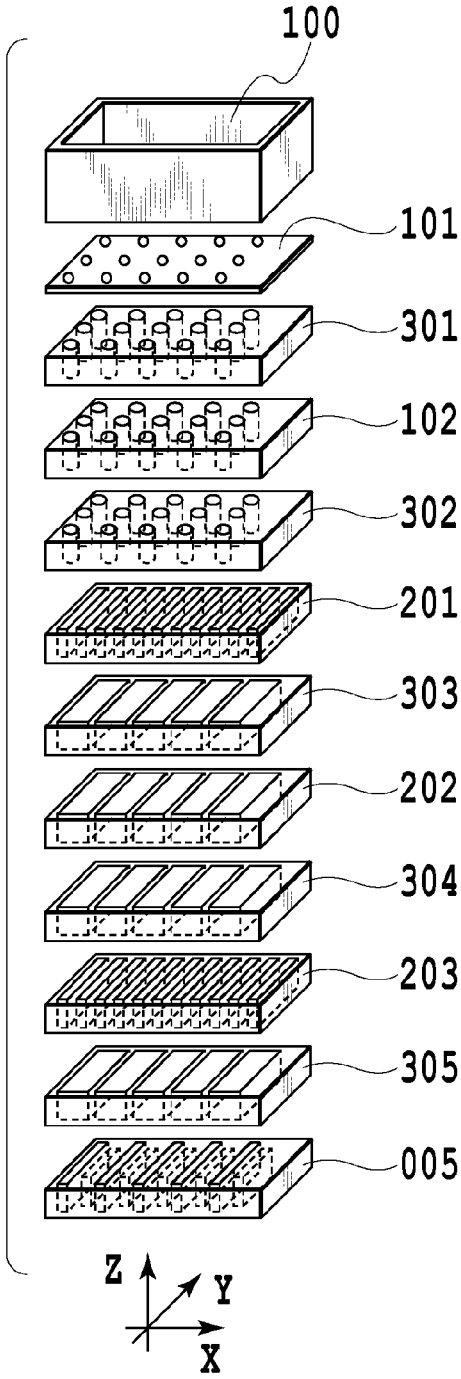

Also, a plurality of nozzles 111 may be provided, similarly to the first embodiment. FIGS. 20A and 20B are a perspective view and an exploded perspective view of a head in the case where slit-shaped apertures of the present embodiment are applied to a plurality of nozzles 111. Similarly to the case of providing a plurality of nozzles 111 in the first embodiment, by taking the members constituting the head to be planar members corresponding to the plurality of nozzles, assembly becomes much simpler than individually providing an electrode plate for each nozzle. Furthermore, since the electrodes corresponding to individual nozzles in the respective electrode plates 201, 202, and 203 of the converging-deflecting electrode 103 may have the same potential, and since individual switching is not required, wiring can be simplified. Moreover, in the present embodiment, since each slit-shaped aperture can be shared by all nozzles on a nozzle row, manufacturing becomes easier than the case of individually providing an aperture corresponding to droplets from each individual nozzle 111. This also has the advantage of enabling a denser nozzle arrangement. Also, long, slit-shaped electrode aperture gaps are less likely to experience blockage due to misting than the case of individually providing round apertures, and even in the unlikely case of accumulated mist, there is an advantage of easy cleaning.

Seventh Embodiment

Figure 21:
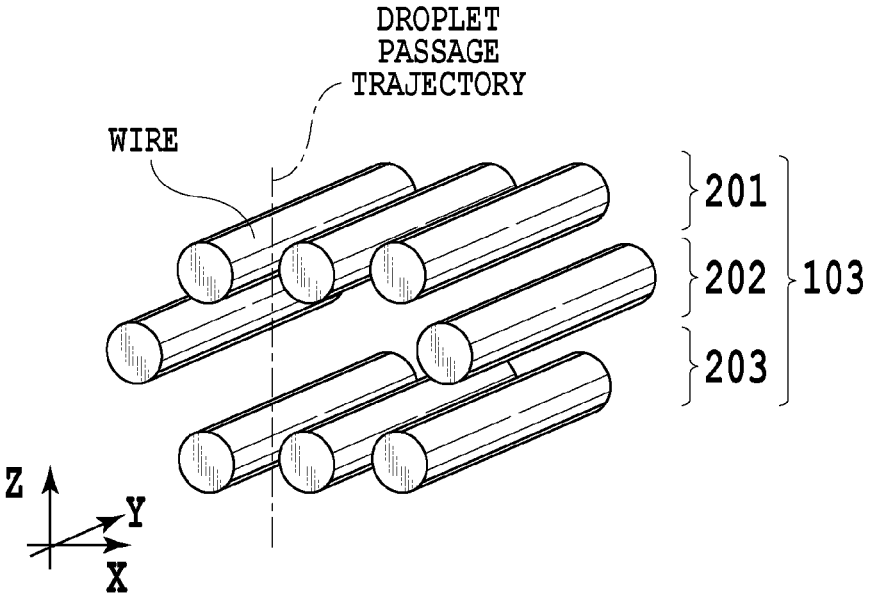
FIG. 21 is a perspective view of a converging-deflecting electrode in a seventh embodiment of the present invention.

A seventh embodiment of the present invention will now be described. In the present embodiment, the converging-deflecting electrode 103 is made up of eight wire-shaped electrodes stacked perpendicularly to the droplet forward trajectory in a 3-2-3 configuration, as illustrated in FIG. 21. The respective layers are taken to be the electrodes 201, 202, and 203. Although each electrode layer is made up of a plurality of wires, the same voltage value is applied to all wires in the same electrode layer. By making the electrode shapes wire-shaped in this way, the electrodes and the structure supporting the electrodes can be reduced, and much space can be acquired around the electrodes. For this reason, a configuration resilient to ink mist buildup and ink blockage at the electrodes is realized.

The wires are all circular in cross-section with a diameter of 60 μm, and stretched parallel to the Y axis. The core-to-core distance between all adjacent wires in the first and third converging-deflecting electrode 201 and 203 is 150 μm. The droplet flight trajectory passes through a position equidistant from two adjacent wires. Meanwhile, the core-to-core distance between the two wires in the second converging-deflecting electrode 202 is 350 μm, with the droplet trajectory passing through a position 100 μm away from the core of one wire, and 250 μm away from the core of the other wire. In other words, the electrode shapes of the first and third converging-deflecting electrode 201 and 203 are symmetric with respect to the droplet trajectory in the X-axis direction, whereas the electrode shape of the second converging-deflecting electrode 202 is asymmetric.

The disposition and shape of other components such as the nozzle 111 and the charging electrode plate 102 are similar to that of the first embodiment. The operating conditions of the pressure pump 002 and the vibrating mechanism 003 are also similar to those of the first embodiment, with the droplet size similarly being 4 pL and the ejection velocity similarly being approximately 10 m/s but reduced to approximately 8 m/s when passing through the converging-deflecting electrode 103.

If the charging voltage applied to print droplets is taken to be 80 V and the charging voltage $V_c$ applied to non-print droplets is taken to be −80 V, the charge magnitude becomes $-1.2\times10^{-13}$ C and $1.2\times10^{-13}$ C, respectively. The converging-deflecting electrode 103 is positioned 2 mm away from the nozzle, and the print medium is positioned 3 mm away from the nozzle.

Figure 22A:
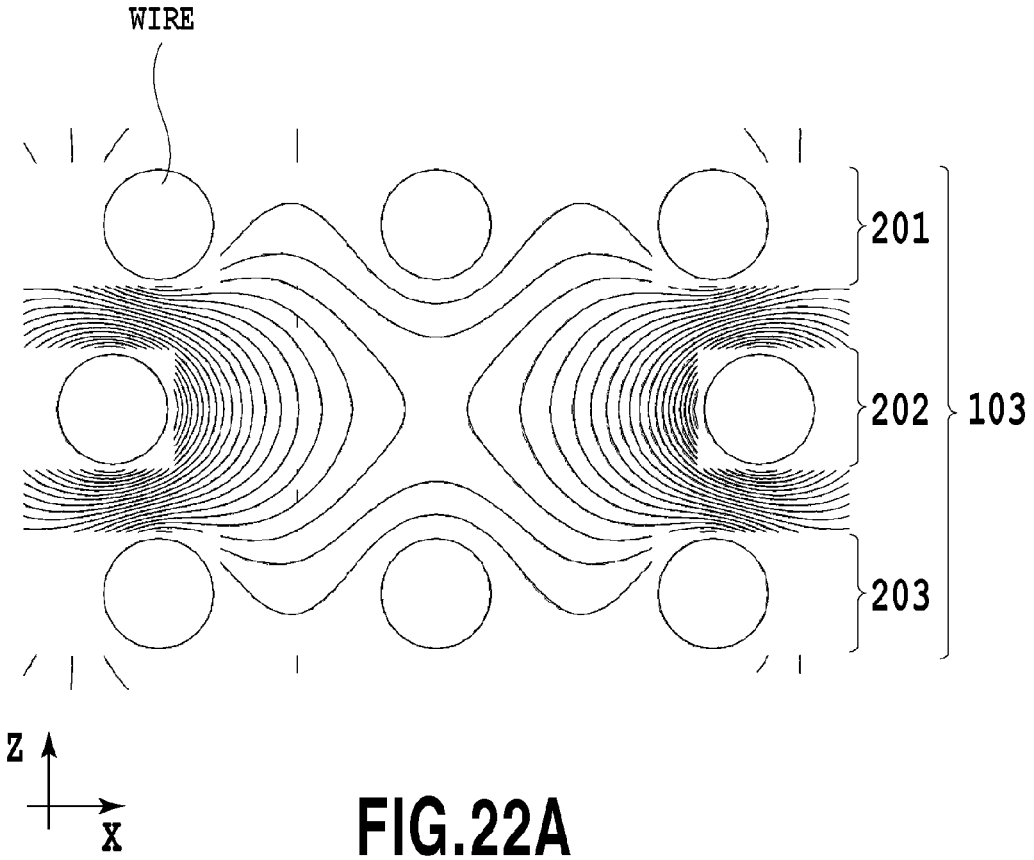
FIGS. 22A to 22C illustrate an electric field and droplet flight trajectories in a seventh embodiment of the present invention.

Equipotential lines of electric fields in the converging-deflecting electrode and trajectories of charged droplets were simulated while taking the voltage $V_{d1}$ of the first converging-deflecting electrode 201 to be 0 V, the voltage $V_{d2}$ of the second converging-deflecting electrode 202 to be 500 V, and the voltage $V_{d3}$ of the third converging-deflecting electrode 203 to be 0 V. For the simulation, the 3D non-linear electrostatic field analysis software ELFIN (ELF Corporation) was used. FIG. 22A illustrates equipotential lines on the XZ plane. Electric fields symmetric with respect to the droplet forward trajectory are formed around the first converging-deflecting electrode 201 and the third converging-deflecting electrode 203. In contrast, an electric field asymmetric with respect to the droplet forward trajectory is formed near the aperture in the second converging-deflecting electrode 202. This is similar to the analysis results in the first embodiment.

Figure 22B:
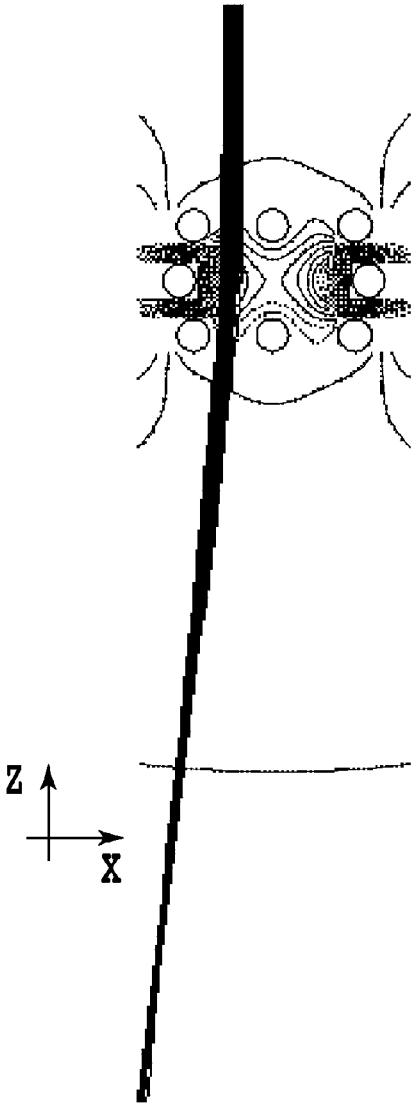
Figure 22C:
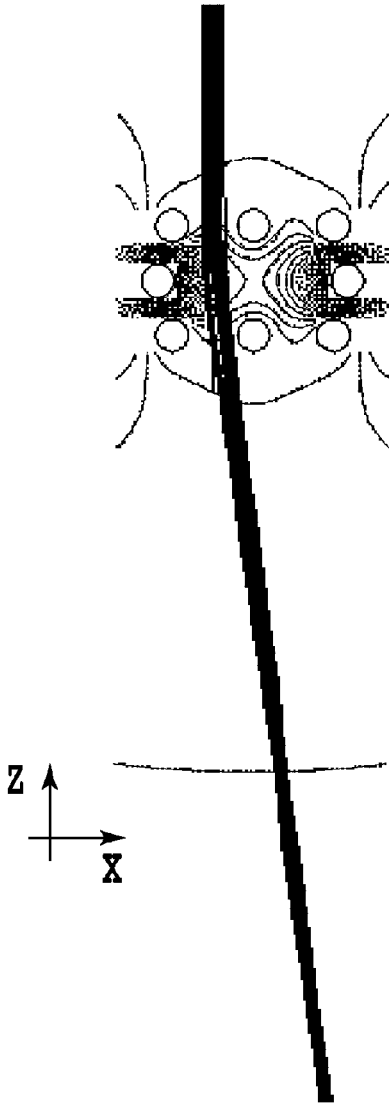

FIG. 22B illustrates flight trajectories of negatively charged print droplets in the case where droplet ejection is shifted −20 μm, −10 μm, 0 μm, 10 μm, and 20 μm from the aperture centerline of the first converging-deflecting electrode 201 in the X-axis direction while keeping parallel to the Z axis. FIG. 22B demonstrates how droplets converge while being deflected (in the −X direction). Meanwhile, FIG. 22C illustrates the results of conducting similar calculations on flight trajectories of positively charged non-print droplets. FIG. 22C demonstrates that non-print droplets are deflected in the direction opposite that of the print droplets (i.e., the +X direction). A gutter 005 may be provided along the flight trajectories of such non-print droplets. The above demonstrates that there are converging and deflecting effects even when the converging-deflecting electrode is wire-shaped. However, since electric fields having a lens effect are not formed, converging effects are not obtained with respect to the Y direction in the present embodiment.

Eighth Embodiment

Figure 23:
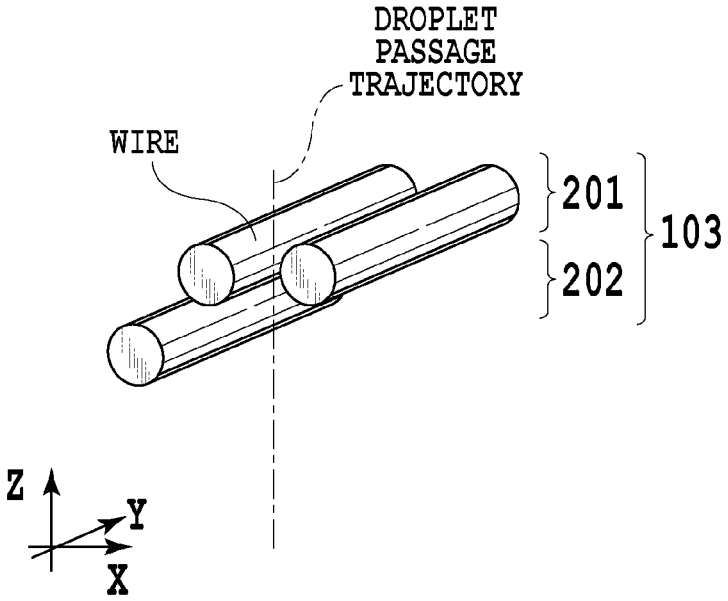
FIG. 23 is a perspective view of a converging-deflecting electrode in an eighth embodiment of the present invention.

An eighth embodiment of the present invention will now be described. In the present embodiment, the converging-deflecting electrode 103 is made up of wires similarly to the seventh embodiment, as illustrated in FIG. 23. The wires are all circular in cross-section with a diameter of 60 μm, and stretched parallel to the Y axis. There are a total of three wires, with two of the wires forming a first electrode 201 on a plane perpendicular to the droplet forward trajectory, and the remaining wire forming a second electrode 202.

The core-to-core distance between the two wires of the first converging-deflecting electrode 201 is 150 μm. The droplet flight trajectory passes through a position equidistant from the two wires. Meanwhile, the core of the wire of the second converging-deflecting electrode 202 is positioned 100 μm away from the droplet trajectory. In other words, the electrode shape of the first converging-deflecting electrode 201 is symmetric with respect to the droplet trajectory in the X-axis direction, whereas the electrode shape of the second converging-deflecting electrode 202 is asymmetric.

The disposition and shape of other components such as the nozzle 111 and the charging electrode plate 102 are similar to that of the first embodiment. The operating conditions of the pressure pump 002 and the vibrating mechanism 003 are also similar to those of the first embodiment, with the droplet size similarly being 4 pL and the ejection velocity similarly being approximately 10 m/s but reduced to approximately 8 m/s when passing through the converging-deflecting electrode 103.

If the charging voltage applied to print droplets is taken to be 80 V and the charging voltage $V_c$ applied to non-print droplets is taken to be −80 V, the charge magnitude becomes $-1.2\times10^{-13}$ C and $1.2\times10^{-13}$ C, respectively. The converging-deflecting electrode 103 is positioned 2 mm away from the nozzle, and the print medium is positioned 3 mm away from the nozzle.

Figure 24A:
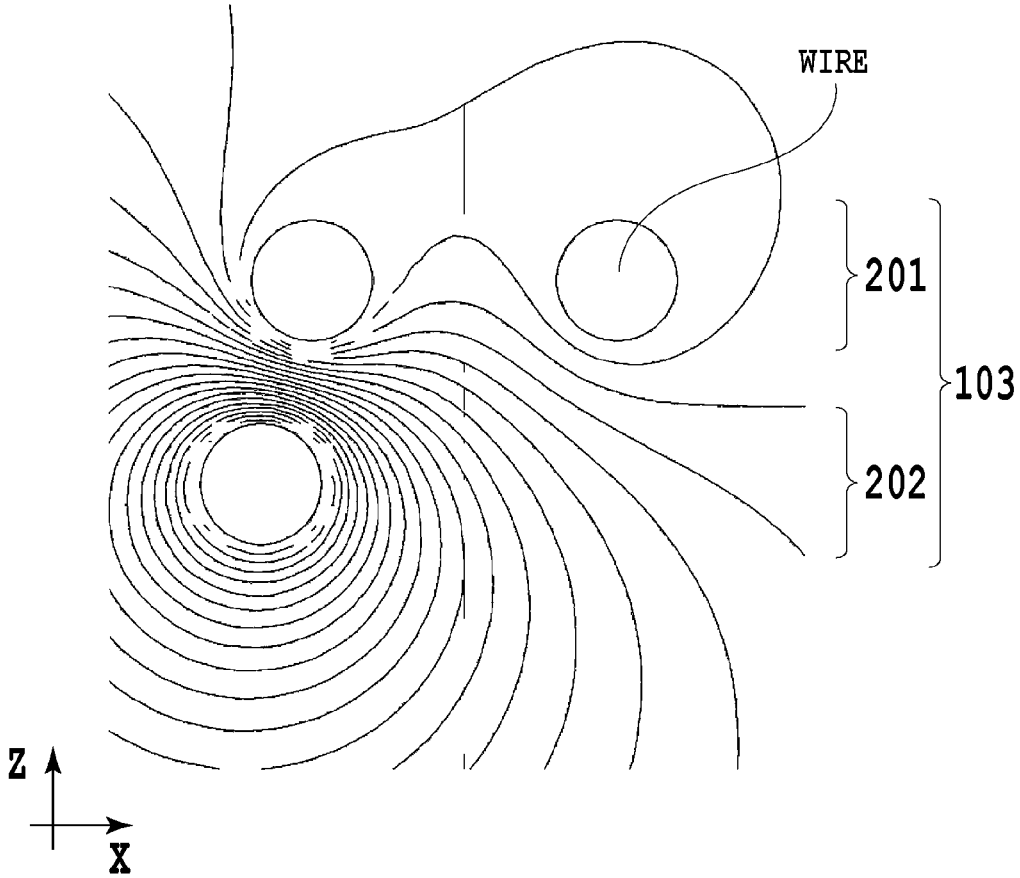
FIGS. 24A to 24C illustrate an electric field and droplet flight trajectories in an eighth embodiment of the present invention.

Equipotential lines of electric fields in the converging-deflecting electrode and trajectories of charged droplets were simulated while taking the voltage $V_{d1}$ of the first converging-deflecting electrode 201 to be 0 V and the voltage $V_{d2}$ of the second converging-deflecting electrode 202 to be 500 V. For the simulation, the 3D non-linear electrostatic field analysis software ELFIN (ELF Corporation) was used. FIG. 24A illustrates equipotential lines on the XZ plane. An electric field symmetric with respect to the droplet forward trajectory is formed around the first converging-deflecting electrode 201. In contrast, an electric field asymmetric with respect to the droplet forward trajectory is formed near the aperture in the second converging-deflecting electrode 202. This is similar to the analysis results in the first embodiment.

Figure 24B:
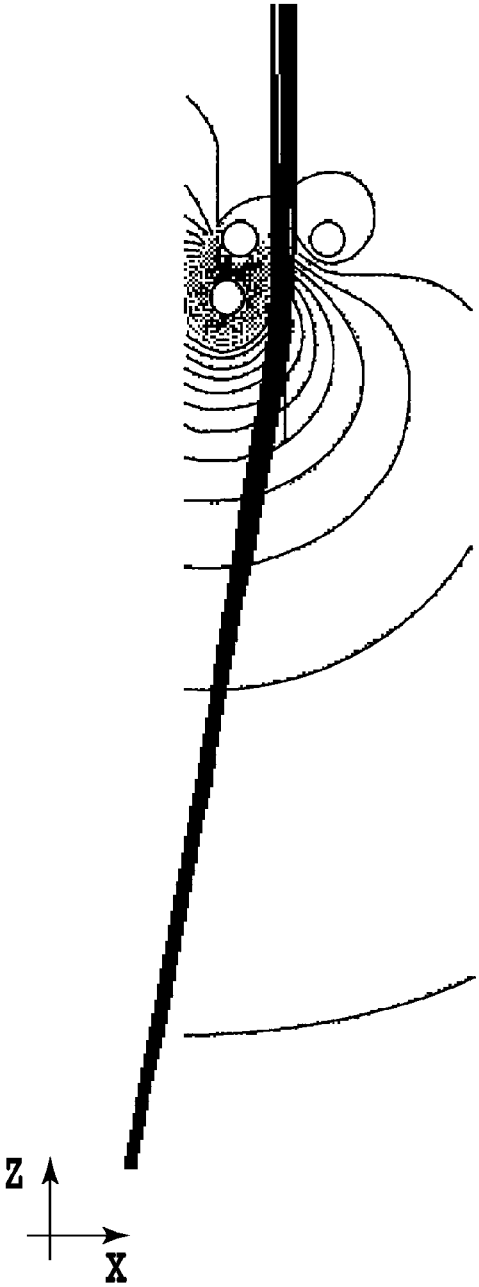
Figure 24C:
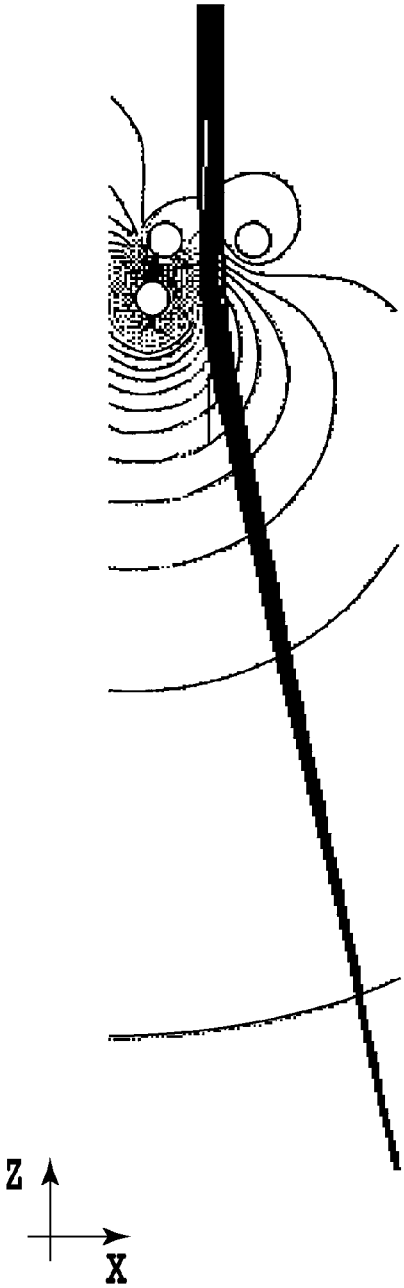

FIG. 24B illustrates flight trajectories of negatively charged print droplets in the case where droplet ejection is shifted −20 μm, −10 μm, 0 μm, 10 μm, and 20 μm from the aperture centerline of the first converging-deflecting electrode 201 in the X-axis direction while keeping parallel to the Z axis. FIG. 24B demonstrates how droplets converge while being deflected (in the −X direction). Meanwhile, FIG. 24C illustrates the results of conducting similar calculations on flight trajectories of positively charged non-print droplets. FIG. 24C demonstrates that non-print droplets are deflected in the direction opposite that of the print droplets (i.e., the +X direction). A gutter 005 may be provided along the flight trajectories of such non-print droplets. The above demonstrates that there are converging and deflecting effects even when the converging-deflecting electrode is made up of at least three wires. However, since electric fields having a lens effect are not formed, converging effects are not obtained with respect to the Y direction in the present embodiment.

Figure 25A:
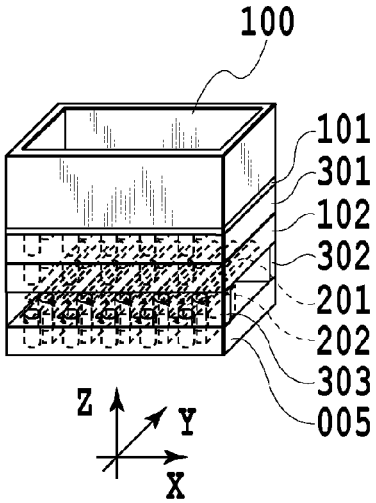
FIGS. 25A and 25B are a perspective view and an exploded perspective view of a droplet ejection head in an eighth embodiment of the present invention.
Figure 25B:
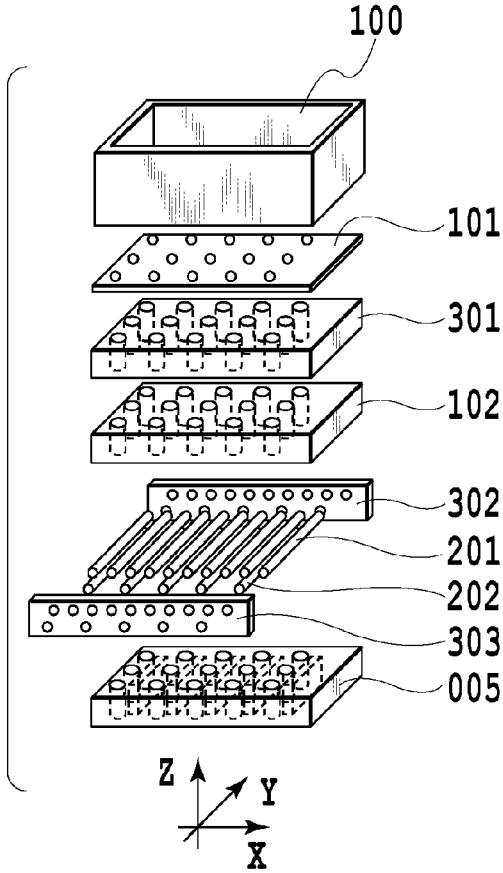

Also, a plurality of nozzles 111 may be provided, similarly to the first embodiment. FIG. 25A is a perspective view of a head in the case where wire-shaped apertures of the present embodiment are applied to a plurality of nozzles 111. Similarly to the case of providing a plurality of nozzles 111 in the first embodiment, by taking the members constituting the head to be wire members corresponding to the plurality of nozzles and by stretching the wires between support plates 302 and 303, assembly becomes much simpler than individually providing an electrode plate for each nozzle. Furthermore, since the electrodes corresponding to individual nozzles in the respective electrodes 201 and 202 of the converging-deflecting electrode 103 may have the same potential, and since individual switching is not required, wiring can be simplified. Moreover, in the present embodiment, since each wire-shaped aperture can be shared by all nozzles on a nozzle row, manufacturing becomes easier than the case of individually providing an aperture corresponding to droplets from each individual nozzle 111. This also has the advantage of enabling a denser nozzle arrangement. Also, much space is acquired around the wire-shaped electrodes, and there is an advantage of a reduced likelihood of blockage due to misting compared to the case of individually providing round apertures or providing slit-shaped electrodes.

Error due to fluctuations in droplet velocity can also be decreased by making the print droplet deflection direction and the print medium conveyance direction the same, similarly to the first embodiment.

Since a converging-deflecting electrode in accordance with an embodiment of the present invention converges and deflects charged particles with a simple electrode configuration, a compact charged particle control apparatus can be manufactured. Also, since a droplet ejection head in accordance with an embodiment of the present invention includes electrodes with converging and deflecting effects, such a head can be utilized in the creation of a high-definition droplet ejection head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2010-144285, filed Jun. 24, 2010, 2010-245540, filed Nov. 1, 2010 which are hereby incorporated by reference herein in their entirety.

What is claimed is:

1. A droplet ejection head, comprising:

a nozzle for ejecting droplets;

a charging electrode that applies a first charge to droplets used for printing and applies a second charge or no charge to droplets not used for printing from among flying droplets ejected from the nozzle, the second charge differing from the first charge in at least one from among electrical charge and polarity; and a deflecting electrode provided with an aperture for allowing flying droplets to pass through and including a plurality of electrodes arranged in a direction of a trajectory axis line along which the droplets enter the aperture, the deflecting electrode deflecting droplets to which a charge has been applied by the charging electrode, wherein the deflecting electrode includes a first electrode and a second electrode having a potential difference therebetween, and the electric field formed by the potential difference is asymmetric with respect to the trajectory axis line near the first electrode, and symmetric with respect to the trajectory axis line near the second electrode.

2. The droplet ejection head according to claim 1, wherein the shape of the aperture in the first electrode is symmetric with respect to the trajectory axis line, and the shape of the aperture in the second electrode is asymmetric with respect to the trajectory axis line.

3. The droplet ejection head according to claim 1, wherein the deflecting electrode includes three electrodes arranged in the direction of the trajectory axis line, of the three electrodes, the two outer electrodes disposed on either end in the direction of the trajectory axis line have a different shape than the inner electrode disposed between the two outer electrodes, and the potential of the inner electrode is lower or higher than either potential of the two outer electrodes.

4. The droplet ejection head according to claim 3, wherein the shape of the aperture of the outer electrodes is symmetric with respect to the trajectory axis line, and the shape of the aperture of the inner electrode is asymmetric with respect to the trajectory axis line.

5. The droplet ejection head according to claim 3, wherein the three electrodes are disposed at equal intervals, the two outer electrodes have equal potentials, and the shapes of the two outer electrodes are the same.

6. The droplet ejection head according to claim 3, wherein the three electrodes each have a supporting member having an aperture at the position where the trajectory axis line passes through, and the shapes of the apertures in the supporting members are the same.

7. The droplet ejection head according to claim 1, wherein a plurality of the ejection heads are arranged along a direction perpendicularly orthogonal to the droplet flight direction.

8. The droplet ejection head according to claim 7, wherein the charging electrode, the first deflecting electrode, and the second deflecting electrode are respective planar members provided with an aperture for allowing droplets ejected from the nozzle to pass through, in each of the charging electrode, the first deflecting electrode, and the second deflecting electrode, a plurality of the apertures are arranged in a first direction along the principal surface of the planar member and a second direction along the principal surface that differs from the first direction, respectively, and the charging electrode, the first deflecting electrode, and the second deflecting electrode are stacked in the direction in which droplets are ejected from the nozzle.

9. The droplet ejection head according to claim 7, wherein the charging electrode is formed of a planar member provided with an aperture for allowing droplets ejected from the nozzle to pass through, the first deflecting electrode and the second deflecting electrode are respectively formed of one or more parallel wires, a plurality of the apertures are arranged in a first direction along the principal surface of the planar member and a second direction along the principal surface that differs from the first direction, respectively, in each of the first deflecting electrode and the second deflecting electrode, the one or more wires are arranged parallel to the first direction along the principal surface of the planar member, and the charging electrode, the first deflecting electrode, and the second deflecting electrode are stacked in the direction in which droplets are ejected from the nozzle.

10. A droplet ejection apparatus, comprising:

a nozzle for ejecting droplets;

a charging electrode that applies a first charge to droplets used for printing and applies a second charge or no charge to droplets not used for printing from among flying droplets ejected from the nozzle, the second charge differing from the first charge in at least one from among electrical charge and polarity; and a deflecting electrode provided with an aperture for allowing flying droplets to pass through and including a plurality of electrodes arranged in a direction of a droplet trajectory axis line, the deflecting electrode deflecting droplets to which a charge has been applied by the charging electrode, wherein the deflecting electrode includes a first electrode and a second electrode having a potential difference therebetween, the electric field formed by the potential difference is asymmetric with respect to the trajectory axis line near the first electrode, and symmetric with respect to the trajectory axis line near the second electrode, and the direction in which droplets used for printing are deflected by the deflecting electrode is the same direction as the direction in which a print medium is conveyed.

11. A droplet ejection apparatus, comprising:

a nozzle for ejecting droplets;

a charging electrode that applies a first charge to droplets used for printing and applies a second charge or no charge to droplets not used for printing from among flying droplets ejected from the nozzle, the second charge differing from the first charge in at least one from among electrical charge and polarity; and a deflecting electrode provided with an aperture for allowing flying droplets to pass through and including a plurality of electrodes arranged in a direction of a droplet trajectory axis line, the deflecting electrode deflecting droplets to which a charge has been applied by the charging electrode, wherein the deflecting electrode includes a first electrode and a second electrode having a potential difference therebetween, the electric field formed by the potential difference is asymmetric with respect to the trajectory axis line near the first electrode, and symmetric with respect to the trajectory axis line near the second electrode, and the charge applied by the charging electrode differs in polarity between droplets used for printing and droplets not used for printing.

12. A deflecting electrode for modifying the flight trajectory of charged particles by using an electric field produced by applying a voltage between electrodes, comprising:

a plurality of electrodes provided with an aperture for allowing flying droplets to pass through and arranged in a direction of a trajectory axis line along which the droplets enter the aperture, wherein each of the plurality of electrodes includes a first electrode and a second electrode having a potential difference therebetween, and the electric field formed by the potential difference is asymmetric with respect to the trajectory axis line near the first electrode, and symmetric with respect to the trajectory axis line near the second electrode.

* * * * *